US012055338B2

(12) United States Patent
Almaguer et al.

(10) Patent No.: US 12,055,338 B2
(45) **Date of Patent: *Aug. 6, 2024**

(54) ELECTRONIC DISPLAY MOUNTING IN DISPLAY CASE DOOR

(71) Applicant: Anthony, Inc., Sylmar, CA (US)

(72) Inventors: Pedro Almaguer, North Hills, CA (US); David Briggs Baugh, Palmdale, CA (US); Mark Sandnes, Granada Hills, CA (US); Dexter Maluto, Sylmar, CA (US)

(73) Assignee: Anthony, Inc., Sylmar, CA (US)

( * ) Notice: Subject to any disclaimer, the term of this patent is extended or adjusted under 35 U.S.C. 154(b) by 268 days.

This patent is subject to a terminal disclaimer.

(21) Appl. No.: 17/682,865

(22) Filed: Feb. 28, 2022

(65) Prior Publication Data

US 2023/0184481 A1 Jun. 15, 2023

Related U.S. Application Data

(60) Provisional application No. 63/287,930, filed on Dec. 9, 2021.

(51) Int. Cl.
*F25D 23/00* (2006.01)
*A47F 3/00* (2006.01)
(Continued)

(52) U.S. Cl.
CPC ..... *F25D 23/028* (2013.01); *A47F 3/001* (2013.01); *A47F 3/0434* (2013.01); *A47F 11/06* (2013.01);
(Continued)

(58) Field of Classification Search
CPC ..... F25D 23/00; F25D 23/006; F25D 23/02; F25D 23/028; F25D 23/063;
(Continued)

(56) References Cited

U.S. PATENT DOCUMENTS

D263,835 S 4/1982 Ahrens
D292,204 S 10/1987 Booty et al.
(Continued)

FOREIGN PATENT DOCUMENTS

CA 3013728 2/2019
CN 209121756 7/2019
(Continued)

OTHER PUBLICATIONS

[No Author Listed], "0.093/(2.36) Housings, Plug and Receptacle, 12 CKT, 0.198/(5.03)CTR," Molex, Nov. 13, 2014, 2 pages.
(Continued)

*Primary Examiner* — Chi Q Nguyen
(74) *Attorney, Agent, or Firm* — Fish & Richardson P.C.

(57) ABSTRACT

A display case door includes an insulated panel assembly, a door frame, and one or more mounting blocks. The insulated panel assembly is transparent to visible light. The door frame extends about and is coupled to the insulated panel assembly. The one or more mounting blocks are coupled to and extend inwardly from the door frame. The electronic display assembly includes an electronic display, and one or more side brackets coupled to the electronic display. At least one of the side brackets of the electronic display assembly is coupled to at least one of the one or more mounting blocks. The electronic display is at least partially supported on at least one of the one or more mounting blocks.

20 Claims, 15 Drawing Sheets

(51) Int. Cl.

| | |
|---|---|
| ***A47F 3/04*** | (2006.01) |
| ***A47F 11/06*** | (2006.01) |
| ***F25D 23/02*** | (2006.01) |
| ***F25D 29/00*** | (2006.01) |

(52) U.S. Cl.
CPC ..... *F25D 29/005* (2013.01); *F25D 2323/02* (2013.01); *F25D 2400/36* (2013.01)

(58) Field of Classification Search
CPC .... F25D 23/064; F25D 23/065; F25D 29/005; F25D 29/00; F25D 2323/02; F25D 2400/36; A47F 3/00; A47F 3/001; A47F 3/005; A47F 3/0434; A47F 3/0426; A47F 3/043; A47F 11/00; A47F 11/06
See application file for complete search history.

(56) References Cited

U.S. PATENT DOCUMENTS

| | | | | |
|---|---|---|---|---|
| 5,910,083 | A | 6/1999 | Richardson et al. | |
| D470,822 | S | 2/2003 | Dyer et al. | |
| D474,486 | S | 5/2003 | Uihlein et al. | |
| D543,951 | S | 6/2007 | Blair et al. | |
| D544,277 | S | 6/2007 | Hoyvik | |
| D760,820 | S | 7/2016 | Lee et al. | |
| D768,738 | S | 10/2016 | Lee et al. | |
| D769,948 | S | 10/2016 | Lee et al. | |
| 9,500,402 | B2 | 11/2016 | Kim et al. | |
| D787,571 | S | 5/2017 | Seo et al. | |
| D826,291 | S | 8/2018 | Lim et al. | |
| D826,295 | S | 8/2018 | Lee | |
| D839,325 | S | 1/2019 | Lee et al. | |
| 10,174,994 | B2 * | 1/2019 | Kim | F25D 23/025 |
| D840,443 | S | 2/2019 | Aulisio | |
| D847,763 | S | 5/2019 | Hirayama | |
| D859,326 | S | 9/2019 | Cox et al. | |
| D859,328 | S | 9/2019 | Gutierrez | |
| 10,767,917 | B2 | 9/2020 | Kim et al. | |
| 10,823,485 | B2 | 11/2020 | Lv et al. | |
| 11,029,075 | B2 | 6/2021 | Yi et al. | |
| 11,047,613 | B1 * | 6/2021 | Park | A47B 96/201 |
| D928,853 | S | 8/2021 | Kim et al. | |
| 11,168,937 | B2 | 11/2021 | Lee | |
| D952,579 | S | 5/2022 | Florczak | |
| 11,320,192 | B2 * | 5/2022 | Lee | F25D 23/028 |
| D959,326 | S | 8/2022 | Kim et al. | |
| 11,402,147 | B2 | 8/2022 | Lee et al. | |
| 11,460,243 | B2 * | 10/2022 | Kim | F25D 23/02 |
| 11,512,895 | B2 * | 11/2022 | Lee | F25D 23/028 |
| D989,005 | S | 6/2023 | Bailey | |
| D990,434 | S | 6/2023 | Fu et al. | |
| D995,451 | S | 8/2023 | Newson | |
| 11,768,027 | B2 * | 9/2023 | Lee | F25D 23/02 312/405 |
| 11,867,450 | B2 * | 1/2024 | Lee | F25C 5/22 |
| D1,019,576 | S | 3/2024 | Almaguer | |
| 2007/0023427 | A1 | 2/2007 | Brennan | |
| 2012/0169196 | A1 * | 7/2012 | Marchetti | E06B 5/006 312/265.6 |
| 2014/0113485 | A1 | 4/2014 | Garcia | |
| 2016/0123654 | A1 | 5/2016 | Lee et al. | |
| 2016/0153221 | A1 | 6/2016 | Dodge et al. | |
| 2017/0176086 | A1 * | 6/2017 | Kang | E05B 47/0038 |
| 2018/0292127 | A1 * | 10/2018 | Park | F25D 27/005 |
| 2019/0024962 | A1 | 1/2019 | Lee et al. | |
| 2019/0050900 | A1 | 2/2019 | Avakian | |
| 2019/0122263 | A1 | 4/2019 | Avakian | |
| 2019/0208925 | A1 * | 7/2019 | Kim | F25D 27/00 |
| 2019/0221144 | A1 | 7/2019 | Artwohl et al. | |
| 2020/0256612 | A1 | 8/2020 | Avakian et al. | |
| 2020/0300538 | A1 | 9/2020 | Avakian et al. | |
| 2020/0326119 | A1 * | 10/2020 | Lee | F25D 23/02 |
| 2021/0041161 | A1 | 2/2021 | Avakian | |
| 2021/0366005 | A1 | 11/2021 | Avakian et al. | |
| 2022/0178173 | A1 | 6/2022 | Arens et al. | |
| 2023/0180948 | A1 | 6/2023 | Almaguer et al. | |
| 2023/0184485 | A1 | 6/2023 | Baugh et al. | |
| 2023/0225065 | A1 * | 7/2023 | Sandnes | H05K 5/03 49/70 |

FOREIGN PATENT DOCUMENTS

| | | |
|---|---|---|
| IN | 256040-0001 | 10/2019 |
| KR | 300817082.0000 | 9/2015 |
| WO | WO 2019/032893 | 2/2019 |
| WO | WO 2020/131881 | 6/2020 |
| WO | WO 2021/150406 | 7/2021 |

OTHER PUBLICATIONS

International Preliminary Report on Patentability in International Appln. No. PCT/US2021/036413, dated Dec. 22, 2022, 12 pages.
International Search Report and Written Opinion in International Appln. No. PCT/US2021/036413, dated Oct. 26, 2021, 15 pages.
International Search Report and Written Opinion in International Appln. No. PCT/US2022/081179, dated Mar. 30, 2023, 15 pages.
Invitation to Pay Additional Fees in International Appln. No. PCT/US2021/036413, dated Aug. 17, 2021, 2 pages.
Office Action in Canadian Appln. No. 3,150,495, dated Apr. 12, 2023, 6 pages.
Office Action in Canadian Appln. No. 3,150,502, dated Apr. 12, 2023, 7 pages.
Office Action in Canadian Appln. No. 3,150,511, dated Apr. 11, 2023, 4 pages.
Amazon.com [online], "True Mods 1-Slot Rocker Switch Panel Housing Kit," Apr. 24, 2018, retrieved on Aug. 29, 2023, retrieved from URL <https://www.amazon.com/ONLINE-LED-STORE-Professional-Automotive/dp/B07CNC59CX?th=1>, 8 pages.

* cited by examiner

ELECTRONIC DISPLAY MOUNTING IN DISPLAY CASE DOOR

CROSS REFERENCE TO RELATED APPLICATIONS

This application claims priority to, and the benefit of, U.S. Application Ser. No. 63/287,930, filed on Dec. 9, 2021, and entitled "Electronic Display Mounting in Display Case Door," the entire contents of which is incorporated by reference herein.

TECHNICAL FIELD

This invention relates to thermally insulated doors for temperature-controlled enclosures.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more thermally insulated doors or windows for viewing and accessing refrigerated or frozen objects within a temperature-controlled space. Doors for refrigerated enclosures generally include thermally insulated glass panel assemblies.

SUMMARY

The present disclosure relates to an electronic display for a display case door for a refrigerated enclosure.

Implementations of the present disclosure include a display case door including an insulated panel assembly, a door frame, and an electronic display assembly. The insulated panel assembly is transparent to visible light. The door frame extends about and is coupled to the insulated panel assembly. The door frame includes a left side rail, a right side rail, and two or more mounting blocks. The two or more mounting blocks include one or more left side mounting blocks coupled to and extending inwardly from the left side rail, and one or more right side mounting blocks coupled to and extending inwardly from the right side rail. The electronic display assembly includes an electronic display, one or more left side brackets coupled to the electronic display, and one or more right side brackets coupled to the electronic display. At least one of the left side brackets of the electronic display assembly is coupled to at least one of the one or more left side mounting blocks. At least one of the right side brackets of the electronic display assembly is coupled to at least one of the one or more right side mounting blocks. The electronic display is at least partially supported in the door frame on at least one of the one or more left side mounting blocks and at least one of the one or more right side mounting blocks.

In some implementations, at least one of the two or more mounting blocks includes a spacer plate configured to define a lateral spacing of the electronic display with respect to the door frame.

In some implementations, at least one of the side rails includes an inner rim. At least one of the two or more mounting blocks spans a gap between the inner rim of the at least one side rail and a corresponding one of the side brackets of the electronic display assembly.

In some implementations, at least one of the one or more left side brackets or at least one of the one or more right side brackets includes a hinge.

In some implementations, the door frame includes one or more display supports, the electronic display assembly further includes one or more hangers configured to couple with at least one of the display supports, and the hangers are configurable to support the electronic display in the door frame such that at least one of the side brackets is aligned with a corresponding one of the mounting blocks.

In some implementations, the display case door further includes a bezel configured to overlay at least a portion of at least one of the two or more mounting blocks.

Further implementations of the present disclosure include a display case door including an insulated panel assembly, a door frame, and one or more mounting blocks. The insulated panel assembly is transparent to visible light. The door frame extends about and is coupled to the insulated panel assembly. The one or more mounting blocks are coupled to and extend inwardly from the door frame. The electronic display assembly includes an electronic display, and one or more side brackets coupled to the electronic display. At least one of the side brackets of the electronic display assembly is coupled to at least one of the one or more mounting blocks. The electronic display is at least partially supported on at least one of the one or more mounting blocks.

In some implementations, wherein at least one of the mounting blocks includes a spacer plate configured to define a lateral spacing of the electronic display with respect to the door frame.

In some implementations, wherein at least one of the one or more mounting blocks spans a gap between an inner rim of the door frame and a lateral edge of the electronic display assembly.

In some implementations, the door frame includes one or more display supports. The display supports are configurable to support the electronic display on the door frame such that at least one of the side brackets is aligned with a corresponding one of the mounting blocks.

In some implementations, the display case door includes, a bezel configured to overlay at least a portion of at least one of the mounting blocks.

In some implementations, wherein at least one of the side brackets includes a hinge.

In some implementations, wherein the hinge is configured to allow the electronic display to swing out relative to the door frame.

In some implementations, wherein the hinge includes a removable hinge pin.

In some implementations, wherein at least one of the side brackets includes an angle bracket.

In some implementations, wherein: the door frame includes a side rail including an inner rim, and at least one of the mounting blocks is coupled to the inner rim.

In some implementations, wherein: the door frame includes one or more side rails each including an inner rim, and the one or more mounting blocks comprise an upper mounting block and a lower mounting block coupled to the inner rim of at least one of the one or more side rails.

In some implementations, the door frame includes a pair of opposing side rails each including an inner rim, and the one or more mounting blocks comprise: one or more left mounting blocks coupled to a left inner rim, and one or more right mounting blocks coupled to a right inner rim.

In some implementations, at least one of the one or more mounting blocks spans a gap between an inner rim of the door frame and a corresponding one of the side brackets of the electronic display assembly.

In some implementations, the door frame includes an inner rim. The display case door further includes one or more fasteners configured to secure at least one of the one or more mounting blocks to the inner rim of the door frame.

In some implementations, the door frame includes an inner rim, the inner rim of the door frame includes one or more mounting holes. At least one of the mounting holes is aligned with a corresponding aperture in at least one of the mounting blocks. The display case door further includes one or more fasteners configured to secure the at least one mounting block to the inner rim of the door frame.

In some implementations, at least one of the fasteners includes a rivet.

In some implementations, at least one of the fasteners includes a threaded fastener.

In some implementations, at least one of the mounting blocks includes one or more threaded holes. At least one of the threaded holes in the at least one mounting block is aligned with a corresponding aperture in at least one of the one or more side brackets. The display case door further includes one or more threaded fasteners configured to secure the electronic display to the at least one mounting block.

In some implementations, at least one of the mounting blocks includes one or more threaded holes, wherein at least one of the threaded holes is aligned with a corresponding aperture in one of the side brackets.

In some implementations, the door frame includes one or more display supports. The electronic display assembly further includes one or more hangers configured to couple with at least one of the display supports, and the hangers are configured to support the electronic display on the door frame such that at least one of the side brackets is aligned with a corresponding one of the mounting blocks.

In some implementations, the one or more hangers includes two hangers horizontally spaced from one another along a top rail of the door frame.

In some implementations, the display supports comprise one or more locating pins.

In some implementations, at least one of the display supports comprise a locating pin coupled to a top rail of the door frame, at least one of the hangers includes a hanger bracket including one or more apertures, and at least one of the one or more apertures is configured to receive one of the locating pins when the electronic display is positioned in the door frame such that the electronic display is at least partially supported on the at least one locating pin.

Further implementations of the present disclosure include a method of supporting an electronic display in a display case door, including: positioning an electronic display assembly in front of an insulated panel assembly of the display case door: hanging the electronic display assembly on a door frame: while the electronic display assembly is hanging on the door frame, adjusting the position of the electronic display assembly such that each of one or more side brackets on each side of the electronic display assembly aligns with a corresponding spacer plate inwardly extending from a side rail of the door frame: and securing at least one of the one or more side brackets of the electronic display assembly to the corresponding spacer plate such that the electronic display is at least partially supported in the door frame.

In some implementations, securing at least one of the one or more side brackets includes installing a fastener to couple at least one of the side brackets to a corresponding spacer plate.

In some implementations, the method further includes, before positioning the electronic display assembly in front of the insulated panel assembly of the display case door selecting one or more spacer plates each having a width that at least partially spans a gap between the door frame and a lateral edge of the electronic display assembly, and coupling the selected one or more spacer plates with the door frame such that each of the one or more spacer plates extends inwardly from a side rail of the door frame.

In some implementations, at least one of the side brackets includes a hinge, and the method further includes swinging the electronic display away from the insulated panel assembly on at least one of the side brackets.

Further implementations of the present disclosure include a method of supporting an electronic display in a display case door, including: positioning an electronic display assembly in front of an insulated panel assembly of the display case door such that each of one or more side brackets of the electronic display assembly align with a corresponding spacer plate inwardly extending from a side rail of the door frame: and securing at least one of the one or more side brackets of the electronic display assembly to the corresponding spacer plate such that the electronic display is at least partially supported in the door frame.

In some implementations, the method further includes, before positioning the electronic display assembly in front of the insulated panel assembly of the display case door: selecting one or more spacer plates each having a width that at least partially spans a gap between the door frame and a lateral edge of the electronic display assembly, and coupling the selected one or more spacer plates with the door frame such that each of the one or more spacer plates extends inwardly from a side rail of the door frame.

In some implementations, at least one of the spacer plates is selected to span a gap between the door frame and a lateral edge of the electronic display assembly.

In some implementations, at least one of the spacer plates is selected based at least in part on a difference between an exterior width of the electronic display and an interior width of the door frame.

In some implementations, at least one of the spacer plates is selected from a set of spacer plates of varying width.

In some implementations, the method further includes attaching a bezel to the door frame to overlay at least a portion of one or more spacer plates coupling the door frame to the electronic display assembly.

In some implementations, securing at least one of the one or more side brackets of the electronic display assembly to the corresponding spacer plate includes installing a fastener to couple at least one of the side brackets to a corresponding spacer plate.

In some implementations, the method further includes hanging the electronic display assembly on the door frame such that at least one of the one or more side brackets of the electronic display assembly aligns with a corresponding spacer plate extending inwardly from the door frame.

In some implementations, the method further includes fastening, while the electronic display assembly is hanging on the door frame, the at least one side bracket to a corresponding spacer plate such that the electronic display is at least partially supported in the door frame.

In some implementations, fastening the at least one of the side brackets to a corresponding one of the one or more spacer plates includes aligning at least one aperture in the at least one side bracket with a corresponding mounting hole in the spacer plate.

In some implementations, aligning the at least one aperture in the at least one side bracket with a corresponding mounting hole in one of the spacer plates includes adjusting a position of a hanger on a locating pin.

Further implementations of the present disclosure include a system for mounting an electronic display in a door frame of a display case door, including a mounting block configured to couple with a side rail of the door frame and extend inwardly from the side rail, and a bracket configured to couple the electronic display with the mounting block.

In some implementations, the mounting block is configured to at least partially support the electronic display in the door frame when the electronic display is coupled to the door frame.

In some implementations, the mounting block includes a spacer plate configured to define a spacing between the electronic display and the side rail.

In some implementations, the mounting block is configured to couple on an inner rim of the side rail.

In some implementations, the bracket includes a hinge.

In some implementations, the bracket is L-shaped.

Further implementations of the present disclosure include a mounting block for an electronic display including a body. The body includes an outer end configured to couple with a side rail of a door frame of a display case door: an inner end configured to extend inwardly from the side rail when the outer end is coupled with the side rail: and one or more mounting holes in the inner end. At least one of the mounting holes is configured to receive one or more fasteners.

In some implementations, the body is configured to at least partially support the electronic display in the door frame when the electronic display is coupled to the body.

In some implementations, the body includes a spacer plate configured to define a spacing between the electronic display and the side rail.

In some implementations, the spacer plate includes one or more ribs.

In some implementations, at least one of the one or more mounting holes includes internal threads configured to receive a threaded fastener.

In some implementations, the outer end is configured to couple on an inner rim of the side rail.

Further implementations of the present disclosure include a display case door including: an insulated panel assembly: a door frame extending about and coupled to the insulated panel assembly, the door frame including a bottom rail: an electronic display coupled in the door frame: and a power switch coupled to the door frame. The power switch is configured to switch power on and off to the electronic display. The power switch is recessed relative to an outer surface of the door frame.

In some implementations, the power switch is coupled to a bottom rail of the door frame.

In some implementations, the power switch is recessed relative to a bottom surface of the bottom rail.

In some implementations, the display case door further includes a bezel cover coupled between the door frame and the power switch. The power switch is recessed below an exterior surface of the bezel cover.

In some implementations, the display case door further includes a bezel cover coupled between the door frame and the power switch. The power switch at least partially resides in a pocket of the bezel cover.

Particular implementations of the subject matter described in this specification can be implemented so as to realize one or more of the following advantages.

Implementations of the present disclosure may improve the maintainability of electronic displays mounted to a display case door. For example, implementations of the present disclosure may provide for easy replacement or maintenance of electronic displays mounted to a display case door without the need to remove an entire display case door. For example, one person or two persons can safely lift and replace the electronic display without placing uneven shear loading on screws and bracket threads.

Implementations of the present disclosure may allow mounting of an electronic display in a display case door without cutouts or notching of the side rails of the door frame, thereby maintaining structural integrity of side rails and increasing manufacturability and interchangeability among different door sizes and display sizes. For example, implementations of the present disclosure may allow the same electronic display to be implemented in different door sizes. In addition, providing an installation without rail cutouts avoids any reduction in strength or rigidity of the supporting structure for the electronic display.

Implementations of the present disclosure may allow for installation of electronic displays of a given size in different size doors using common tools and a common setup.

Implementations of the present disclosure may simplify display case door removal and increase the safety of the operation by using a quick disconnect power connection. Implementations of the present disclosure may allow for the maintenance of cameras or other small electrical components by only one person (without removing the display screen).

The details of one or more embodiments of the invention are set forth in the accompanying drawings and the description below. Other features, objects, and advantages of the invention will be apparent from the description and drawings, and from the claims.

DETAILED DESCRIPTION

Figure 1:
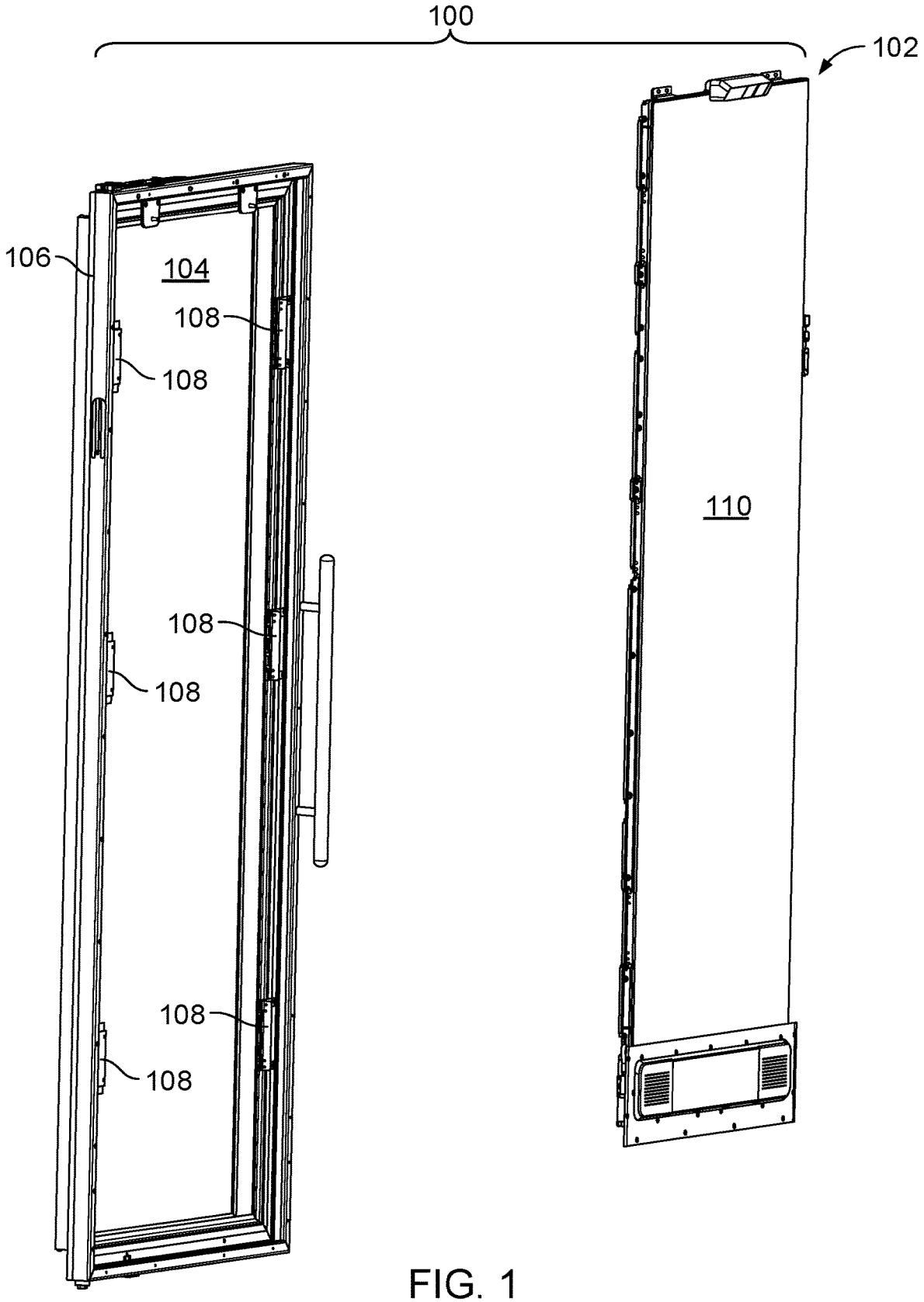
FIG. 1 is an exploded perspective view of an exemplary electronic display case door according to some implementations of the present disclosure.

FIG. 1 is an exploded perspective view of an exemplary arrangement of an electronic display assembly 102 in a display case door 100 according to implementations of the present disclosure. FIG. 1 illustrates an exemplary display case door 100 that can be installed in a refrigerated display case such as a refrigerator, a freezer, or other enclosure defining a temperature-controlled space. Display case door 100 includes an insulated panel assembly 104 or transparent panel, a door frame 106 secured to an edge of insulated panel assembly 104, and mounting blocks 108. Mounting blocks are coupled to door frame 106. The display case door 100 include an electronic display assembly 102 that is coupled to door frame 106 by way of mounting blocks 108. Electronic display assembly 102 can be mounted to door frame 106 so as to overlay all or a majority of insulated panel assembly 104. Electronic display assembly 102 includes electronic display 110.

In some implementations, a display case door includes one or more bezels (omitted from FIG. 1 for clarity). The bezels can cover all or a portion of the mounting blocks and other components for mounting the electronic display assembly 102. The bezels can create a recognized UL wireway:

Insulated panel assembly 104 can include one or more panes of glass. In some implementations, insulated panel assembly 104 includes two or more layers of transparent panes bounding a sealed space in between, forming a sealed glass unit (SGU). Door frame 106 extends around and is secured to a peripheral edge of insulated panel assembly 104. As further described in detail below; door frame 106 defines a channel or tunnel that receives one or more power cables that provide electrical power to the electronic display assembly.

Display case door 100 can include a single electronic display or multiple electronic displays. For example, display case door 100 can include two or more electronic displays vertically stacked and together covering the insulated panel assembly 104.

Electronic display 110 can include, but is not limited to, a liquid crystal display (LCD), a light emitting diode (LED) display; an organic light emitting diode (OLED) display; a field emission display (FED), a plasma display panel (PDP), or an electroluminescent (EL) display. For example, electronic display 110 can be a smart television with streaming capabilities for receiving content over a wireless network (e.g., a Wi-Fi network). Electronic display 110 is generally opaque and, when mounted on the display case door 100 partially or completely obstructs the view through the insulated panel assembly 104. In some implementations, electronic display 110 can be a custom sized display configured to correspond with dimensions of the display case door 100. In some implementations, electronic display 110 can be a commercial off the shelf (COTS) display.

Figure 2:
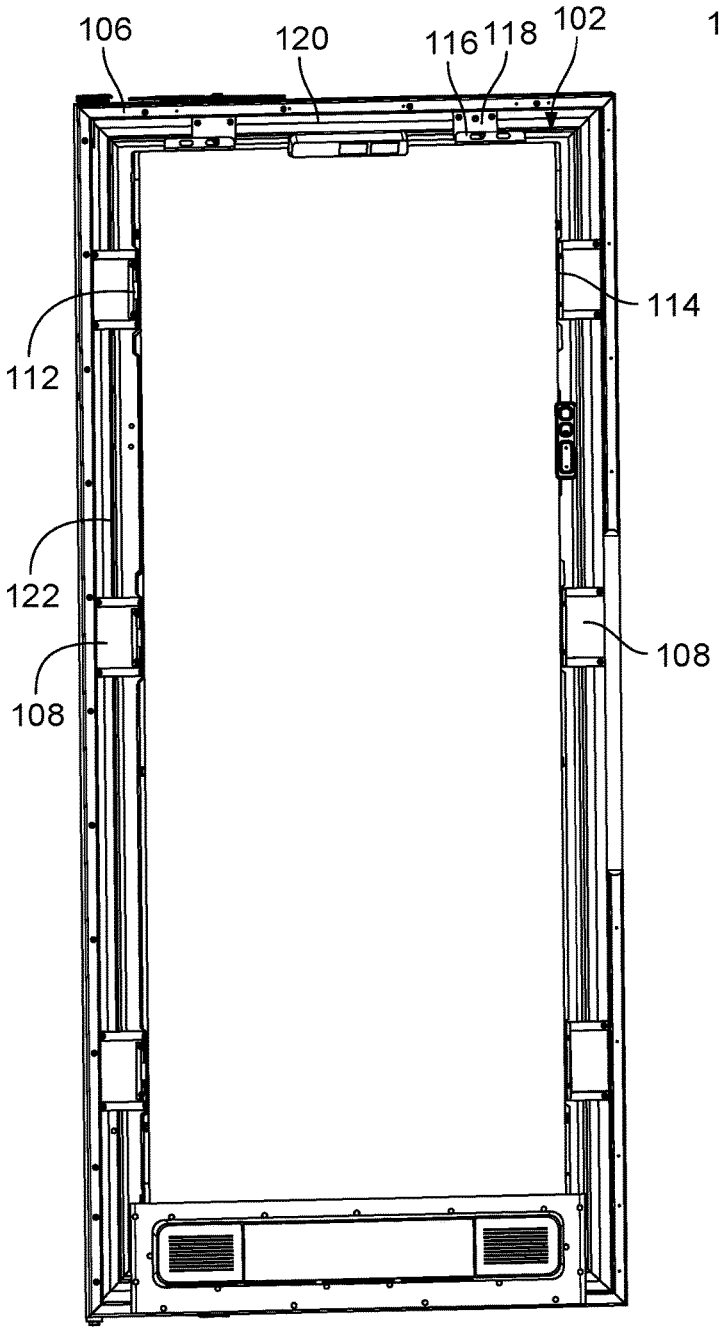
FIG. 2 is a perspective view of the electronic display case door of FIG. 1 with an electronic display mounted in a door frame.
Figure 2A:
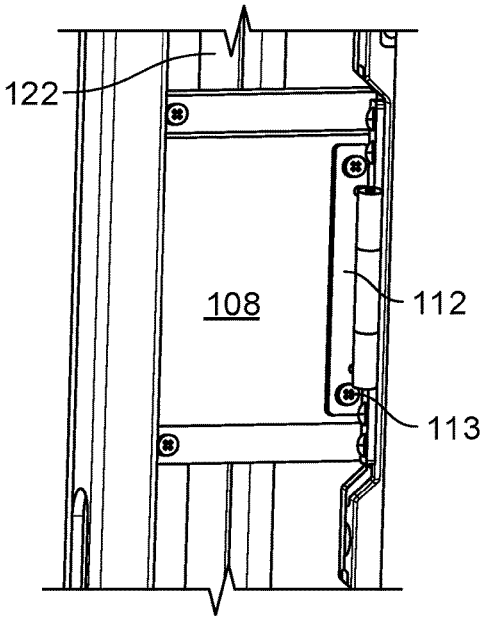
FIGS. 2A and 2B are perspective detail views illustrating mounting of the electronic display assembly.
Figure 2B:
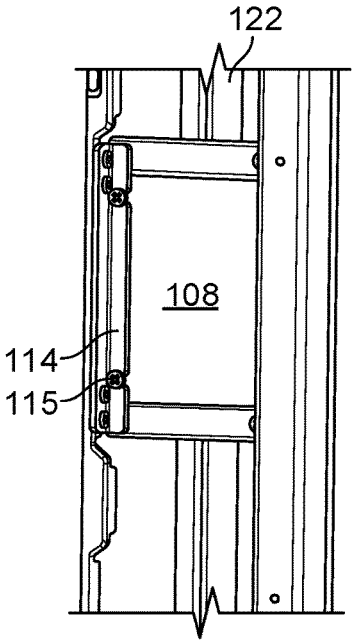

FIG. 2 is a perspective view of the electronic display case door of FIG. 1 with electronic display assembly 102 mounted in door frame 106. FIG. 2A is a perspective detail view illustrating mounting of the electronic display assembly 102 on the left side of the electronic display. FIG. 2B is a perspective detail view illustrating mounting of the electronic display assembly 102 on the right side of the electronic display.

Electronic display assembly 102 includes electronic display 110, left side hinge brackets 112, right side brackets 114, and hangers 116. Left side hinge brackets 112 are attached to electronic display 110 along the left side of electronic display 110. Right side brackets 114 are attached to electronic display 110 along the right side of electronic display 110. Each of left side hinge brackets 112 and right side brackets 114 is secured to a corresponding one of mounting blocks 108 by way of screws 113 and screws 115, respectively: Door frame 106 includes top rail 120 and side rails 122. Electronic display assembly 102 is mounted on mounting blocks 108 on the left side rail 122 of door frame 106 and mounting blocks 108 on the right side rail 122 of door frame 106. Each of hangers 116 can be coupled on a corresponding one of display supports 118.

In the example shown in FIG. 2, electronic display assembly 102 includes three left side hinge brackets 112 and three right side brackets 114. In other examples, an electronic display is secured to a door frame with fewer or more than three brackets and/or corresponding mounting blocks coupled to a door frame. In one example, an electronic display is coupled by way of only one bracket and a corresponding mounting block on each side of the electronic display.

Figure 3:
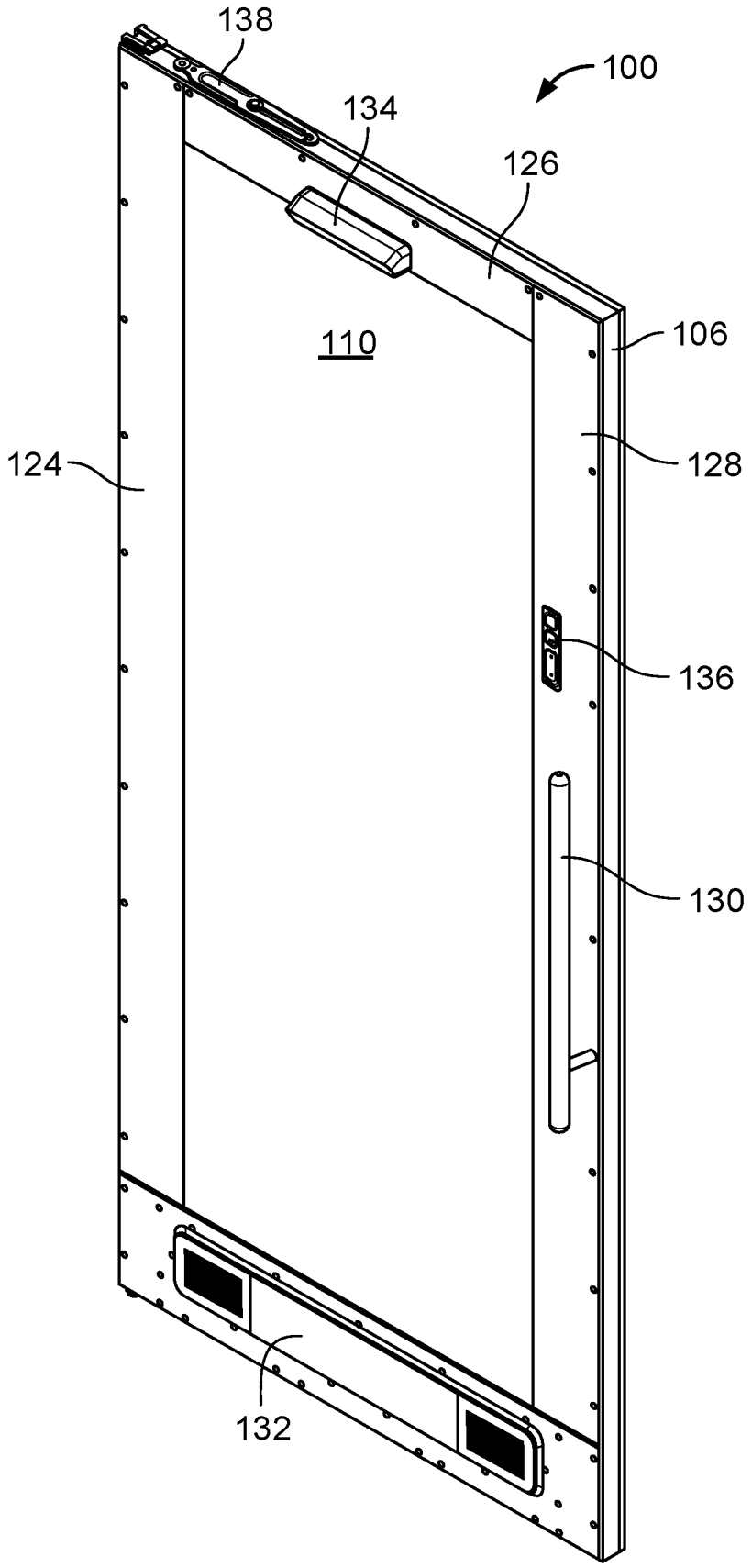
FIG. 3 is a perspective view of the electronic display case door of FIG. 1 with the electronic display assembly mounted in door frame with bezels installed.

FIG. 3 is a perspective view of the electronic display case door of FIG. 1 with electronic display assembly 102 mounted in door frame 106, with bezels installed around the edges of door frame 106. Display case door 100 includes left bezel 124, top bezel 126, and right bezel 128. Each of left bezel 124, top bezel 126, and right bezel 128 overlay and conceal a portion of mounting blocks 108, left side hinge brackets 112, right side brackets 114, hangers 116, and display supports 118.

Display case door 100 includes handle 130. Electronic display assembly 102 includes circuitry module 132, top sensor 134, and handle-side sensor 136. The outside edges of circuitry module 132 are secured to left rail 206 and right rail 208 of door frame 106. Left bezel 124 and right bezel 128 can be attached to their respective rails. Top sensor 134 passes through an opening or cutout in top bezel 126. Handle-side sensor 136 is accessible through a corresponding aperture in right bezel 128.

Hold open bracket 138 is provided on a top edge of display case door 100. One end of hold open bracket 138 is pivotally coupled to door frame 106. In service, hold open bracket 138 can be used to maintain door in a desired open position.

Circuitry module 132 is positioned in a bottom portion of door frame 106. Circuitry module 132 overlays a portion of insulated panel assembly 104. Circuitry module 132 can be attached to electronic display 110 such that, with electronic display 110 releasably coupled to door frame 106, circuitry module 132 is releasably coupled to door frame 106. Circuitry module 132 can include a media player in electronic communication with electronic display 110 to control media content presented on electronic display 110.

Figure 4:
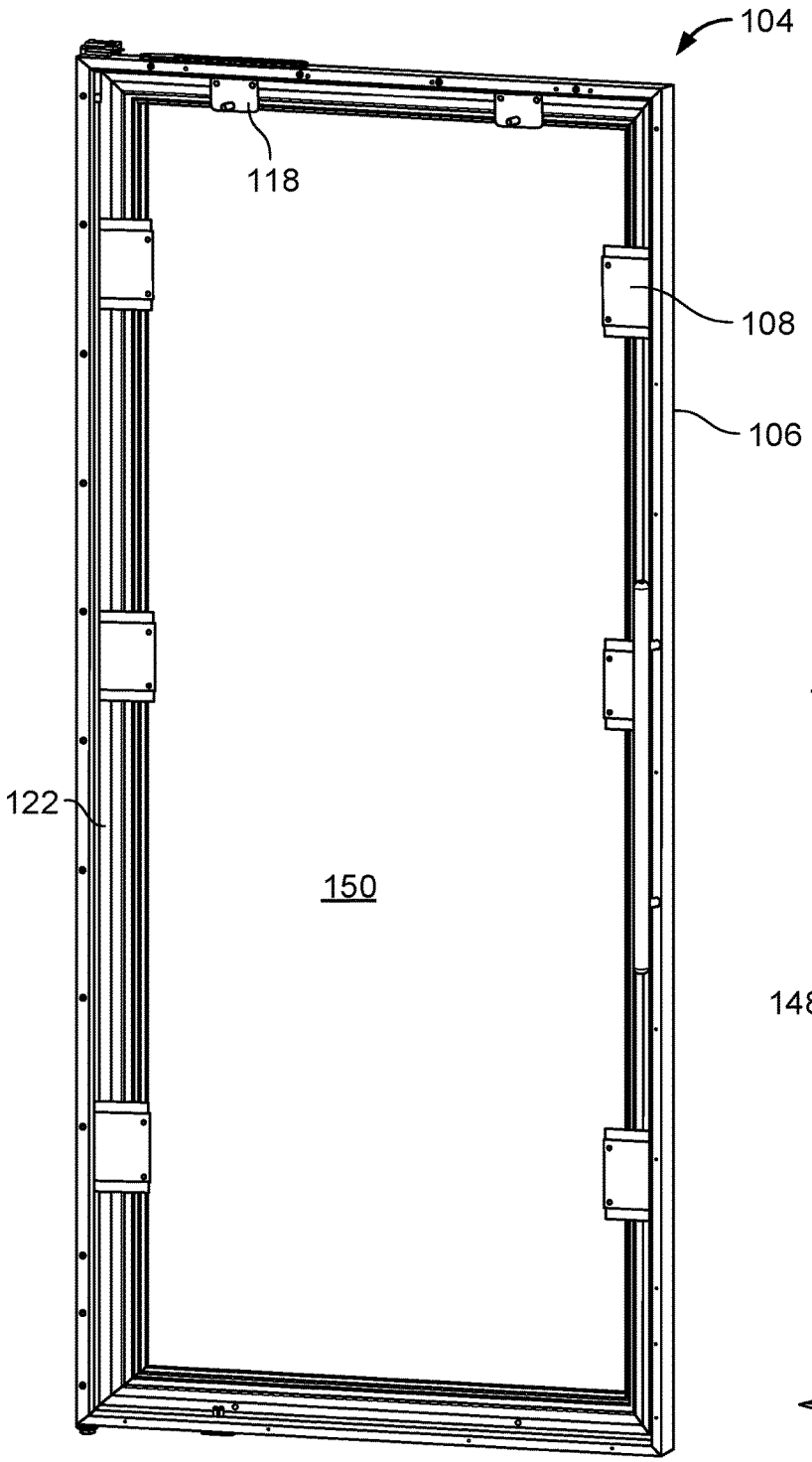
FIG. 4 is a perspective view illustrating a display case door with the electronic display assembly removed.
Figure 4A:
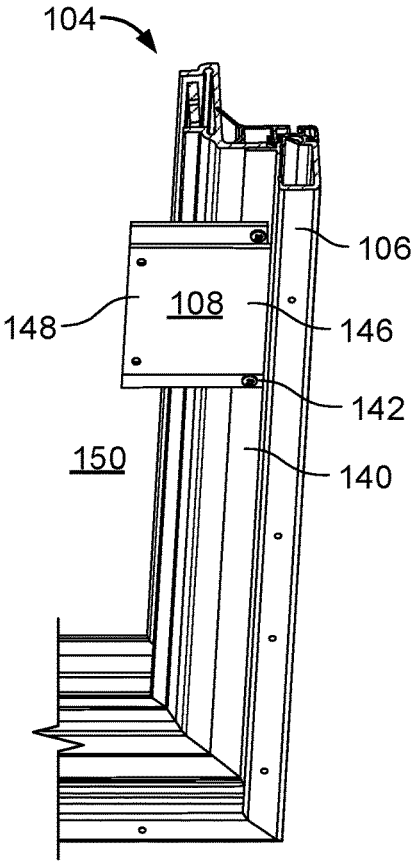
FIG. 4A is a perspective view of a portion of a door frame illustrating installation of a mounting block in a door frame.

FIG. 4 is a perspective view illustrating display case door 100 with electronic display assembly 102 removed. FIG. 4A is a perspective view of a portion of a door frame 106 illustrating one of mounting blocks 108. Mounting block 108 is secured to an inner rim 140 of door frame 106 by way of fasteners 142. Each of mounting blocks 108 extends inwardly from door frame 106. Mounting block 108 is secured to inner rim 140 of door frame 106 by way of fasteners 142 at an outer end 146 of mounting block 108. In some implementations, inner rim 140 includes internally threaded holes for receiving fasteners 142. The internally threaded holes can be in the form of threaded inserts installed at one or more locations on inner rim 140. In some implementations, the internally threaded holes are tapped holes in inner rim 140.

In the example shown in FIG. 4A, mounting block 108 extends inwardly from door frame 106 in front of insulated panel assembly 104. The inside end 148 of mounting block 108 can extend over the glass panels 150 of insulated panel assembly 104.

Figure 5:
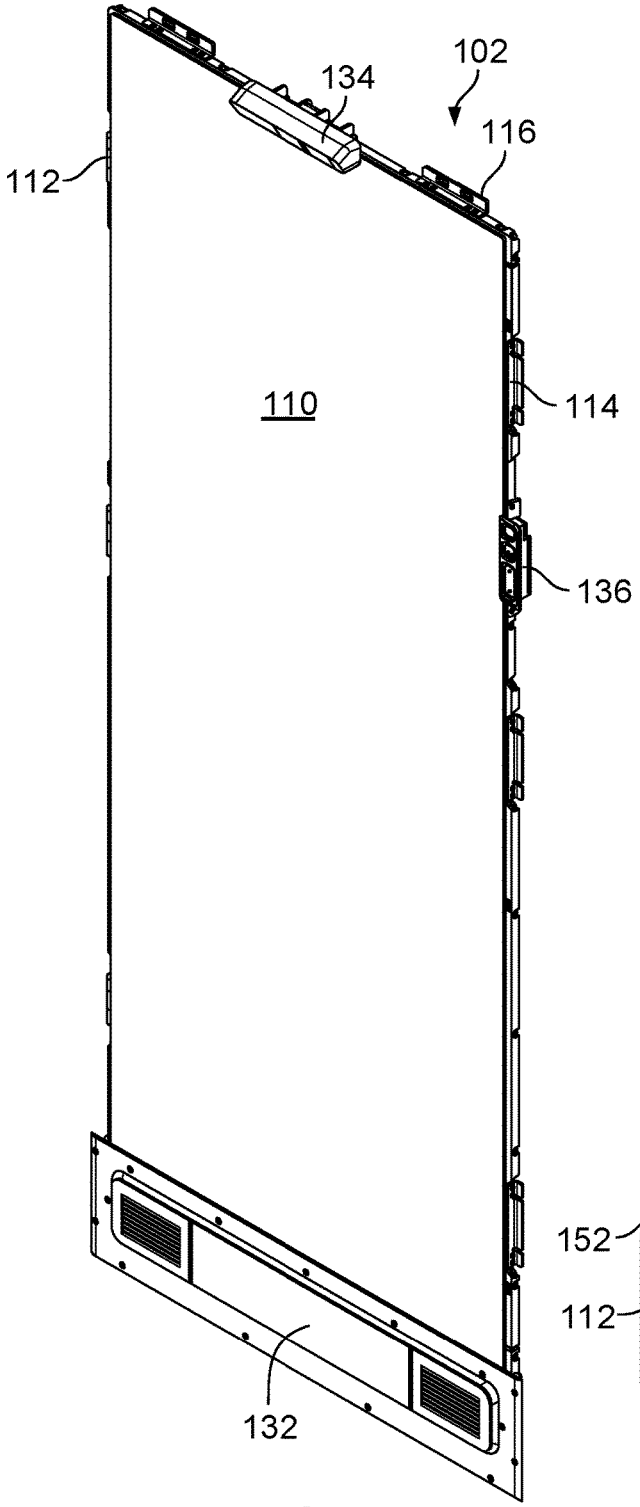
FIG. 5 is a perspective view of the electronic display assembly of FIG. 1.
Figure 5A:
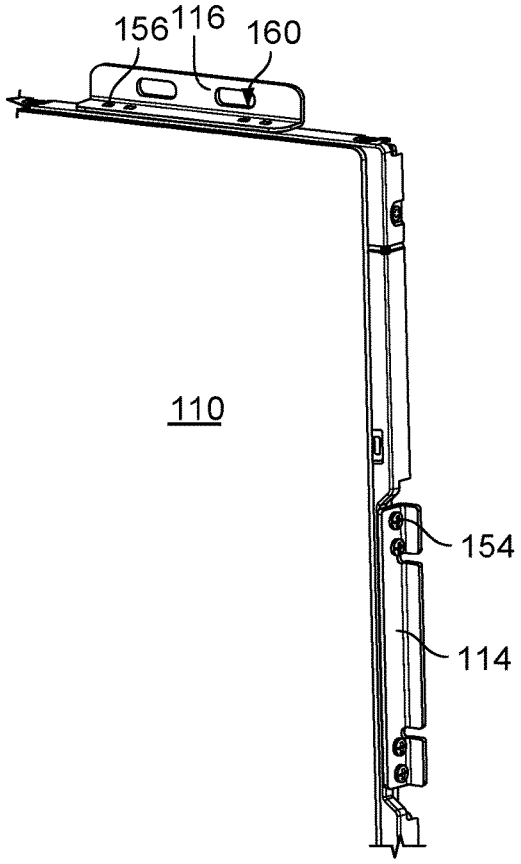
FIGS. 5A and 5B is a perspective detail views of portions illustrating portions of the electronic display assembly.
Figure 5B:
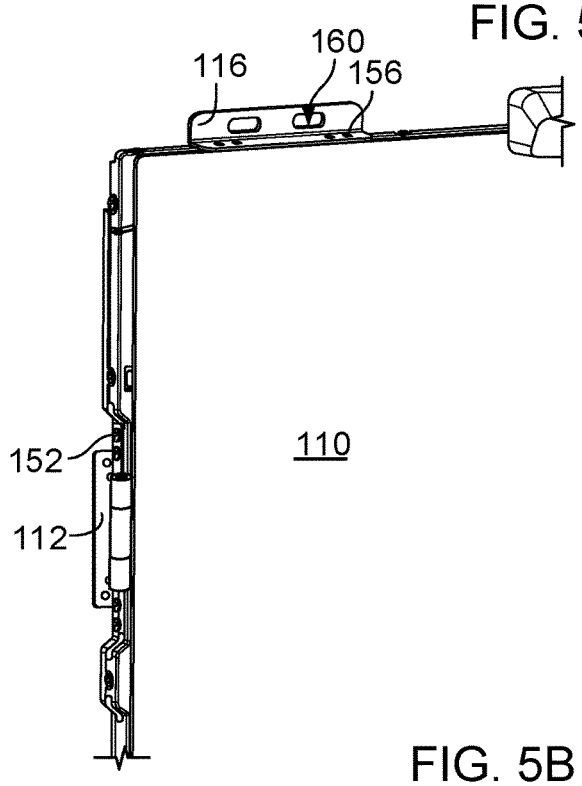

FIG. 5 is a perspective view of the electronic display assembly of FIG. 1. FIG. 5A is a perspective view of the upper right portion of the electronic display assembly. FIG. 5B is a perspective view of the upper left portion of the electronic display assembly. Left side hinge brackets 112 are attached to the left side of electronic display 110 by way of fasteners 152. Right side brackets 114 are attached to the right side of electronic display 110 by way of fasteners 154. Hangers 116 are attached to electronic display 110 by way of fasteners 156. Fasteners 152, 154, and 156 can be screws, bolts, rivets, or another type of fastener. Hangers 116 include slots 160.

Figure 6A:
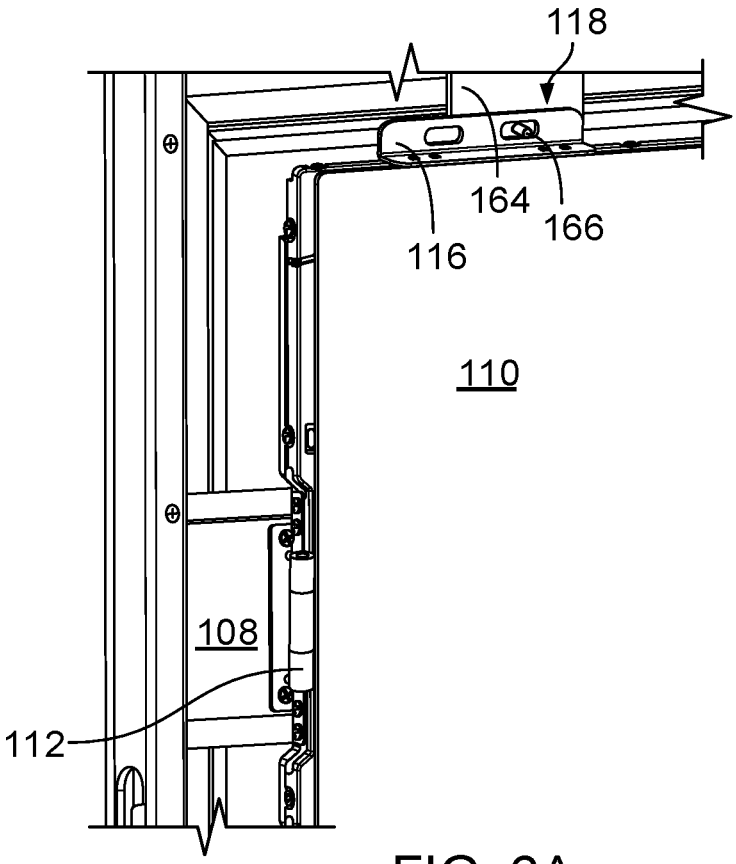
FIGS. 6A and 6B are perspective views of mounting of a left side hinge bracket.
Figure 6B:
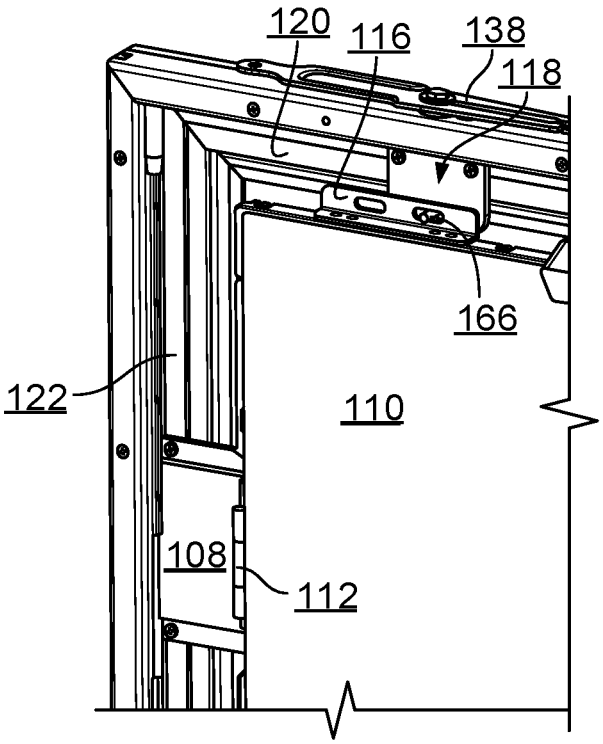

In some implementations, one or more of the mounting blocks serve as a spacer plate. The mounting blocks can define a position of the electronic display relative to a door frame. FIG. 6A is a perspective view of mounting of left side hinge bracket 112 on one of mounting blocks 108 looking inward toward electronic display 110. FIG. 6B is a perspective view of mounting of left side hinge bracket 112 on one of mounting blocks 108 looking outward toward door frame 106. Mounting block 108 is attached to inner rim 140 of insulated panel assembly 104 at outer end 146 of mounting block 108. Left side hinge bracket 112 is secured to inside end 148 of mounting block 108 by way of screws 113. Right side brackets 114 can be secured in a similar manner to that shown in FIGS. 6A and 6B. In one example, screws 113 used to secure left side hinge brackets 112 and screws 115 used to secure right side brackets 114 are #6 pan-head screws.

Along the top edge of electronic display 110, hangers 116 are coupled on display supports 118. In the example shown in FIGS. 5 and 6, there are a pair of hangers spaced across the top edge of electronic display 110.

Display supports 118 include support plate 164 and locating pins 166. Locating pins 166 can pass through slots 160. Display supports 118 are fastened to upper rim 168 of insulated panel assembly 104.

In some implementations, hangers 116 are used to initially support electronic display assembly 102 such that the brackets on either side of electronic display assembly 102 are aligned with corresponding mounting blocks. In this context, aligning the brackets with the mounting blocks 108 can include aligning corresponding features of the brackets and mounting blocks so that one or more fasteners can be installed to secure the electronic display assembly:

Once some or all of the fasteners are installed to secure the brackets of electronic display assembly 102 to corresponding mounting blocks 108, the hangers 116 may no longer be needed to support the electronic display. Thus, in some implementations, hangers 116 serve as an interim support during installation of the electronic display on mounting blocks on the sides of the electronic display. In some implementations, hangers 116 remain in place on electronic display assembly 102 in service. Hangers 116 can thus be reengaged and reused to support the electronic display during maintenance operations (e.g., removal and repair of the electronic display). In certain implementations, hangers 116 can be removed after installation of electronic display assembly 102, and then re-installed as needed to remove electronic display assembly 102 at a later time.

Figure 7:
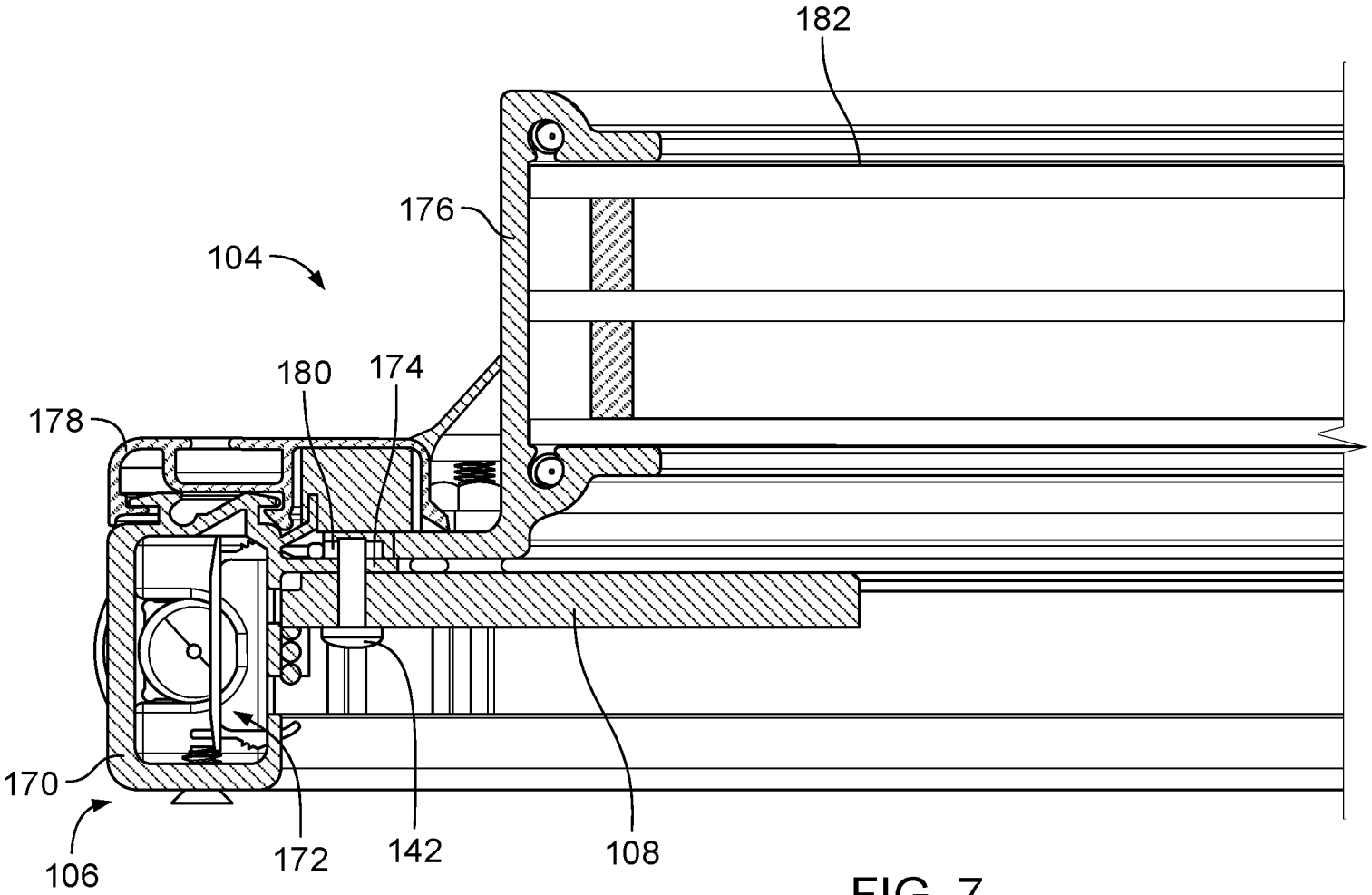
FIG. 7 is a cross sectional view of a mounting block attached to a side door rail on one side of a display case door.

FIG. 7 is a cross sectional view of mounting block 108 attached to a side door rail on one side of a display case door. Door frame 106 includes rail 170. Rail 170 includes channel 172 and inner rim 174. Rail 170 is coupled to subframe member 176. Backing retaining member 178 is secured to rail 170 and subframe member 176. In some implementations, rail 170 is made of an aluminum alloy and subframe member 176 is made of a high-loaded polymer (HLP) material. Subframe member 176 supports and contains glass panels 182.

Inner rim 174 includes bosses 180. Mounting block 108 is secured to rail 170 at bosses 180 by way of fasteners 142. In the example shown in FIGS. 2, 2A, 2B, 6A, and 6B, each mounting block is secured to a rail using two fasteners. One of the fasteners is near the top of the mounting block and another is near the bottom of the mounting block. Inner rim 174 of rail 170 can extend continuously from top to bottom at the mounting location of mounting block 108.

In some implementations, a side rail of a door frame includes captive nuts at each spacer plate fastener location. Each captive nut can receive a corresponding fastener (e.g., fastener 142). Bosses 180 can be omitted.

In the implementation shown in FIG. 7, fasteners 142 are threaded fasteners. Other types of fasteners can be used. In one example, mounting blocks are fastened to a door frame using rivets.

Figure 8A:
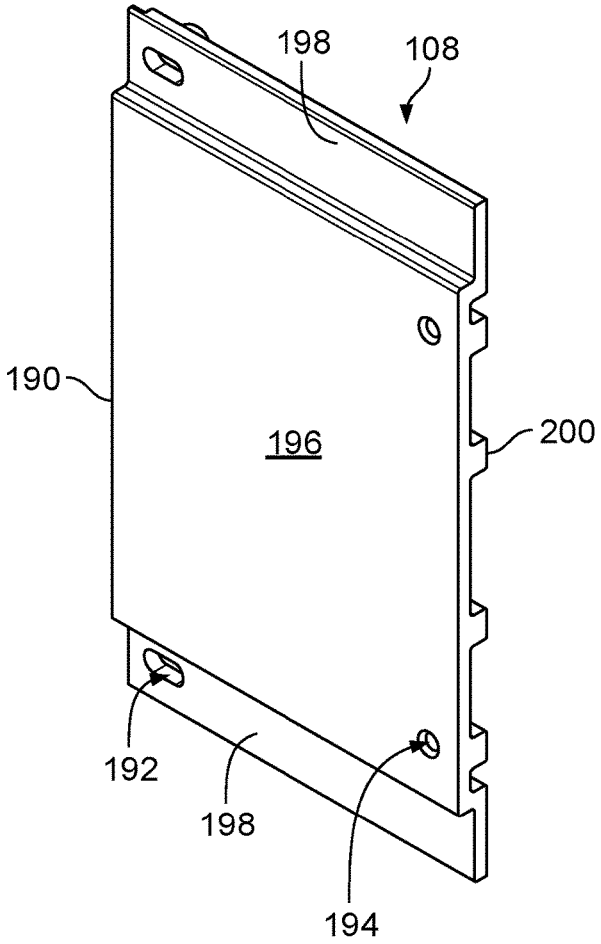
FIG. 8A is a perspective front view of a mounting block according to one implementation.
Figure 8B:
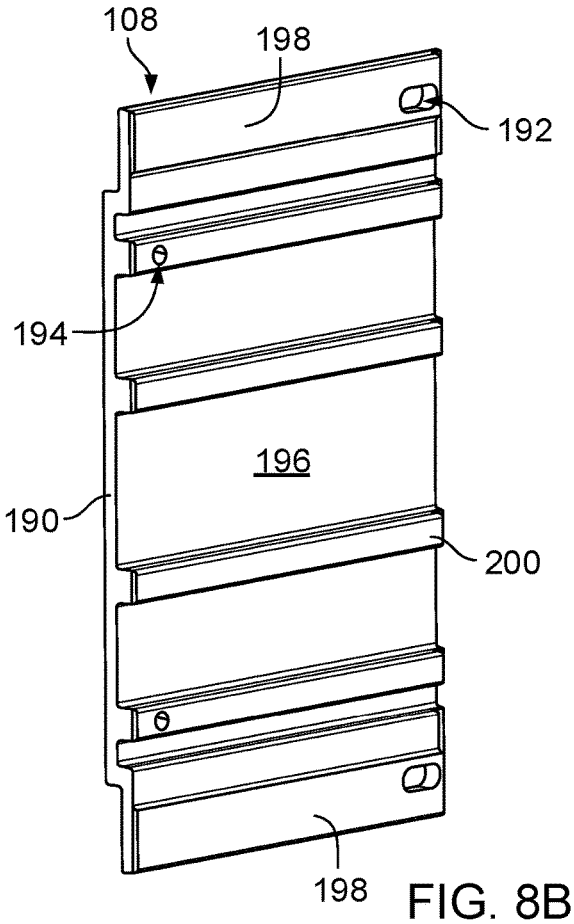
FIG. 8B is a perspective rear view of the mounting block of FIG. 8A.

FIG. 8A is a perspective front view of mounting block 108 according to one implementation. FIG. 8B is a perspective rear view of mounting block 108 of FIG. 8A. Mounting block 108 includes body 190, slots 192, and mounting holes 194. Body 190 includes main plate 196, side rims 198, and ribs 200. Ribs 200 increase the stiffness and strength of mounting block 108. Mounting blocks 108 are made of a material that is stiff enough to support electronic display assembly 102. In one example, mounting blocks 108 are produced from an aluminum extrusion. Examples of other materials for mounting blocks 108 include steel, fiberglass, or a polymer material.

Slots 192 allow for fasteners 142 to pass through for securing mounting block 108 to door frame 106. In one example, mounting blocks 108 are mounted to a door rails glass mount rib. Screws 113 can be installed in mounting holes 194 of mounting blocks 108 to secure each of left side hinge brackets 112 to mounting blocks 108. (In a similar manner, screws 115 can be installed in mounting holes 194 of mounting blocks 108 to secure each of right side brackets 114 to mounting blocks 108.) In some implementations, a mounting block includes clearance holes instead of slots 192.

In certain implementations, the internally threaded holes are the form of threaded inserts installed in body 190. In some implementations, the internally threaded holes are tapped holes in body 190. In the example shown in FIGS. 8A and 8B, each of mounting holes 194 passes through one of ribs 200.

In the example shown in FIGS. 8A and 8B, mounting holes 194 are used for attaching both left side hinge brackets 112 and right side brackets 114. In other cases, a mounting block can include separate mounting holes for the brackets on either side of an electronic display. The mounting holes for attaching the right and left side brackets can be in-line with one another or offset from one another. A common mounting block part can be used on both sides of the electronic display.

Figure 9A:
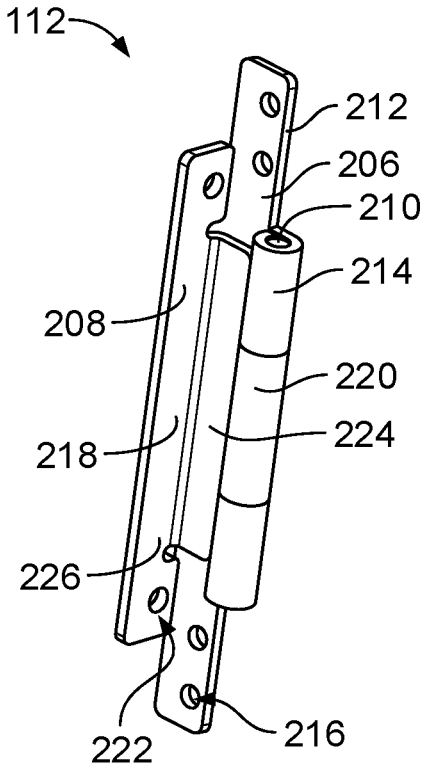
FIG. 9A is a perspective front view of a left side hinge bracket according to one implementation.
Figure 9B:
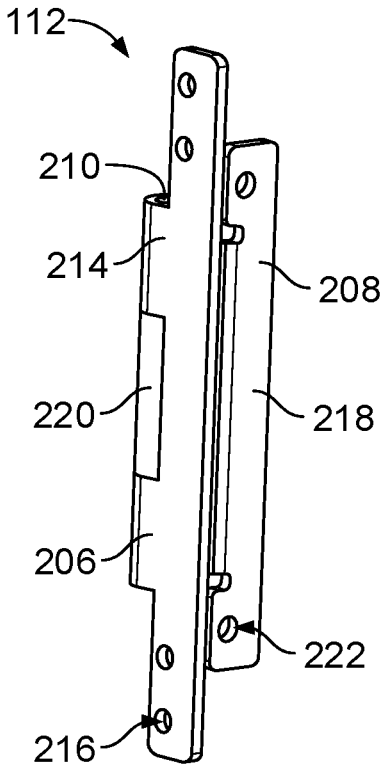
FIG. 9B is a perspective rear view of the left side hinge bracket of FIG. 9A.

FIG. 9A is a perspective front view of left side hinge bracket 112 according to one implementation. FIG. 9B is a perspective rear view of left side hinge bracket 112 of FIG. 9A. Left side hinge bracket 112 includes inside hinge component 206, outside hinge component 208, and pin 210. Inside hinge component 206 includes inside leaf 212, knuckles 214, and mounting holes 216. Outside hinge component 208 includes outside leaf 218, knuckle 220, and mounting holes 222. Outside leaf 218 includes base 224 and leg 226. In this example, base 224 is at a right angle relative to leg 226. Base 224 can contact inside leaf 212 of inside hinge component 206 when electronic display 110 is in installed on door frame 106.

Figure 10A:
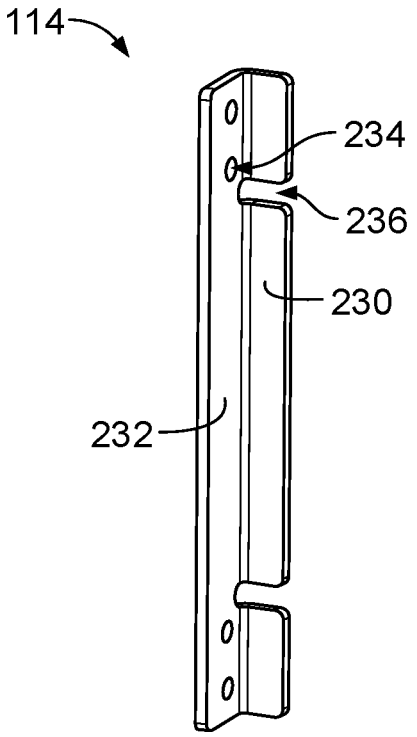
FIG. 10A is a perspective front view of a right side bracket according to one implementation.
Figure 10B:
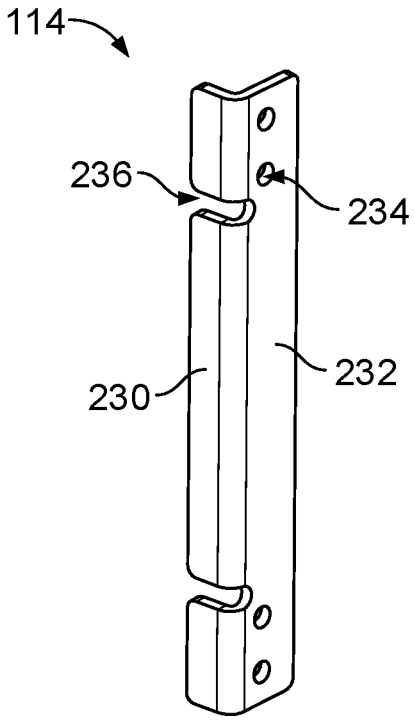
FIG. 10B is a perspective rear view of the right side bracket of FIG. 10A.

FIG. 10A is a perspective front view of right side bracket 114 according to one implementation. FIG. 10B is a perspective rear view of right side bracket 114 of FIG. 9A. In this example, right side bracket 114 is in the form of an "L" shape. Right side bracket 114 includes outside leg 230 and inside leg 232. Outside leg 230 and inside leg 232 are at right angles relative to one another. Inside leg 232 includes mounting holes 234. Outside leg 230 includes slots 236.

To produce electronic display assembly 102, left side hinge brackets 112 are attached to electronic display 110 by installing fasteners 152 through mounting holes 216, and right side brackets 114 are attached to electronic display 110 by installing fasteners 154 through mounting holes 234. Hangers 116 are attached at the top edge of electronic display 110.

In some implementations, mounting hardware installed in door frames accommodates an electronic display of a given size in door frames of different widths and different heights. For example, a system for mounting electronic displays in display case doors can include a set of mounting blocks of different sizes. Each mounting block can serve as a spacer plate that defines the spacing of the electronic display relative to the door frame. The mounting blocks can span a gap between an electronic display assembly and the door frame in which the electronic display assembly is installed. In some implementations, each size of mounting block can accommodate an electronic display of a given size for two or more different size door frames.

In some implementations, the mounting blocks span an inner portion of the door frame and the exterior edge of the electronic display to be installed in the door frame. The mounting blocks define a spacing of the electronic display relative to the door frame. The mounting features of each of the mounting blocks can be aligned with corresponding mounting features of a corresponding bracket on the electronic display assembly. For example, through holes in each bracket of an electronic display assembly can be aligned with corresponding threaded holes in a mounting block. Once the mounting features of the brackets and corresponding mounting blocks are aligned, fasteners can be installed to secure the electronic display assembly to the door frame.

In various examples described herein, an electronic display is centered in a door frame by installing mounting blocks of equal length on either side of the display. In other implementations, the spacer plates on the left and right sides can be of different lengths. In certain implementations, a system can include spacer plates on only one side or the other of an electronic display.

Figure 11C:
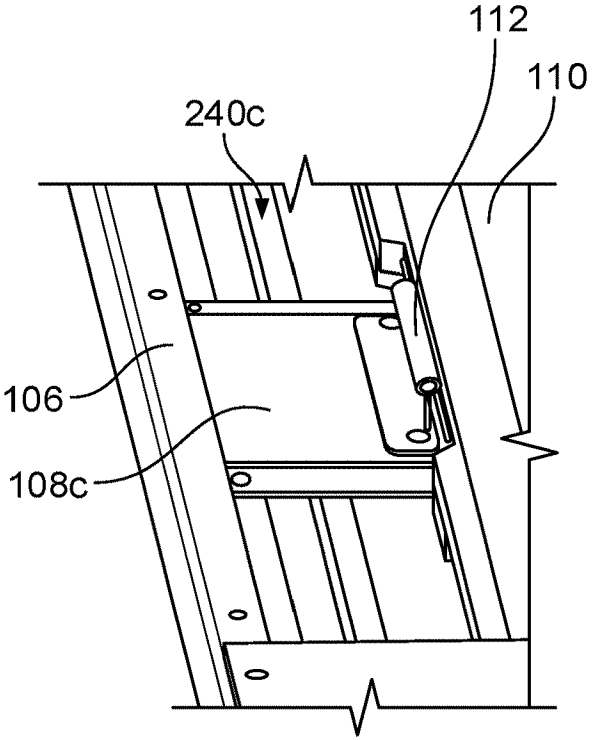
FIGS. 11A, 11B, and 11C illustrate mounting blocks of different sizes according to one implementation.
Figure 11B:
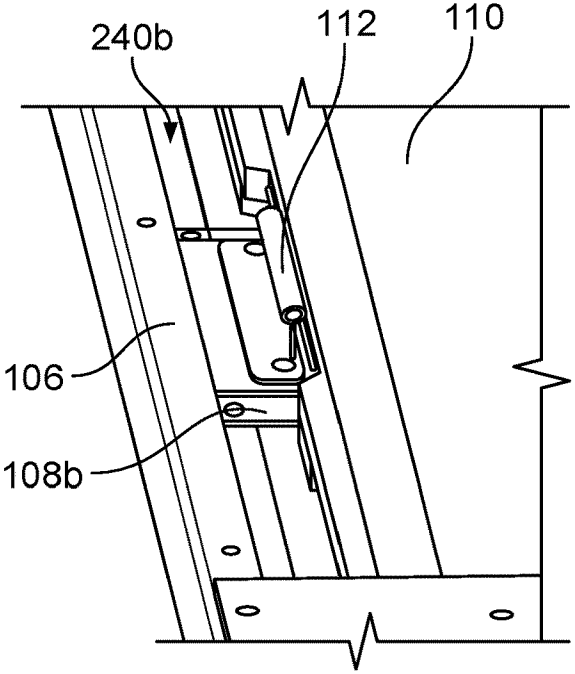
Figure 11A:
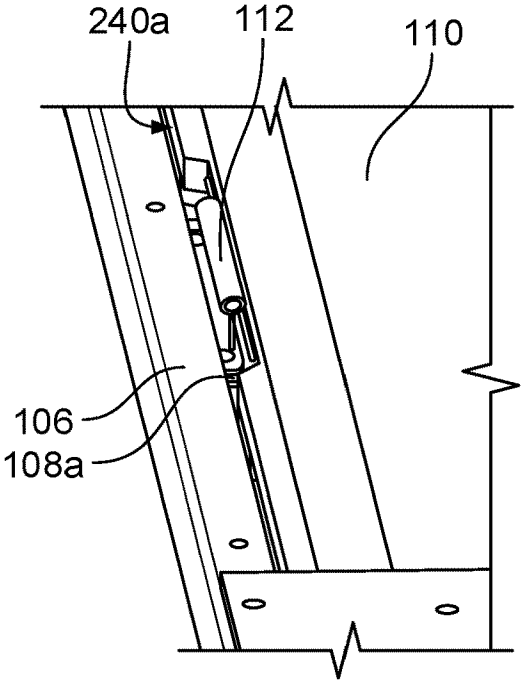

FIGS. 11A, 11B, and 11C illustrate mounting blocks of different sizes according to one implementation. FIG. 11A depicts a mounting block 108*a* that supports a display where there is little or no gap 240*a* between door frame 106 and electronic display 110. FIG. 11B depicts a mounting block 108*b* that extends inwardly from door frame 106 and spans across a gap 240*b* from door frame 106 to electronic display 110. FIG. 11C depicts a mounting block 108*c* that extends inwardly from door frame 106 and spans across a gap 240*c* from door frame 106 to electronic display 110. Each of left side hinge brackets 112 and right side brackets 114 can be coupled to the inner end of any of mounting blocks 108*a*, 108*b*, and 108*c*. In certain implementations, a bracket on an electronic display is attached directly to an inner rim of a door frame, without a mounting block.

In some implementations, all of the mounting blocks in the set (e.g., mounting blocks 108*a*, 108*b*, and 108*c*) are all produced from the same extruded material. Each size of mounting block can be cut to length for the door installation on which it will be used (e.g., based on the spacing between a door frame and the electronic display to be installed in the door frame). In one example, the extruded stock is aluminum. In certain implementations, spacer plates are machined from bar stock.

In some implementations, mounting blocks and support plates are selected to accommodate an electronic display of a given size. Mounting blocks can be selected so that the electronic display is centered horizontally: Display supports can be selected so that mounting brackets on the electronic display are vertically aligned with the mounting blocks on the door frame when the electronic display is hung on the display supports. In this manner, an electronic display of a given size can be installed in doors of several different sizes.

In some implementations, display supports of on a door frame support an electronic display such that the electronic display mounting features of the electronic display vertically align with corresponding mounting features on a door frame when the electronic display is hung on the display supports. In some examples, the length of support brackets and/or the installed height of a locating pin are selected such that mounting blocks on the door frame vertically align with brackets on the electronic display when an electronic display is supported on locating pins of the display supports.

Figure 12C:
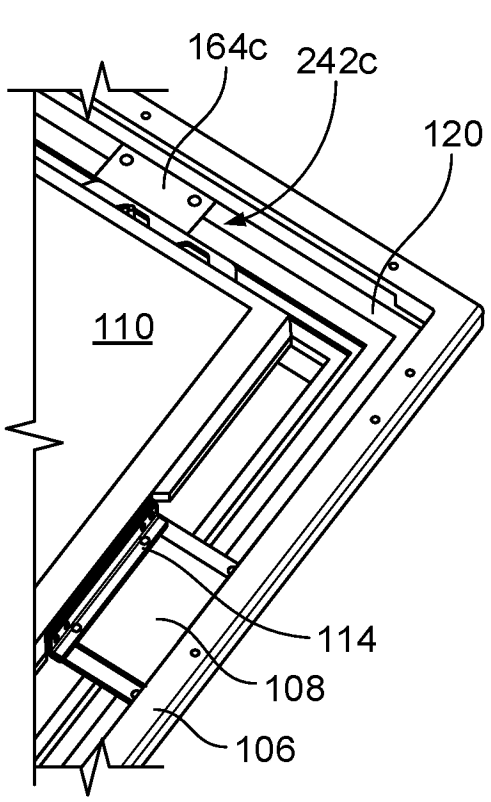
FIGS. 12A, 12B, and 12C illustrate mounting blocks and hanger support plates of different sizes according to one implementation.
Figure 12B:
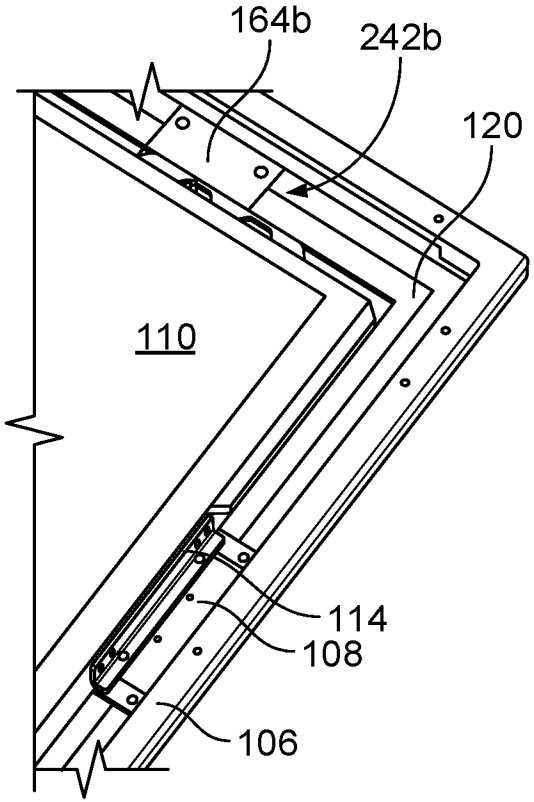
Figure 12A:
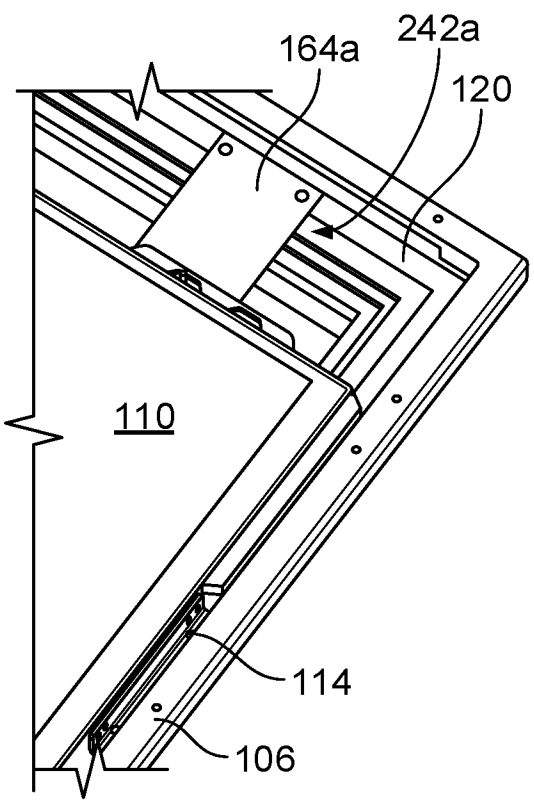

FIGS. 12A, 12B, and 12C illustrate mounting blocks and hanger support plates of different sizes according to one implementation. FIG. 12A depicts a support plate 164*a* that supports electronic display 110 in a door frame of a first size. In this case, there is a relatively large gap 242*a* between top rail 120 of door frame 106 and the top edge of electronic display 110. Hanger 116 hangs on locating pin 166 near the bottom of support plate 164*a*.

FIG. 12B depicts a support plate 164*b* that supports an electronic display 110 in door frame 106 of a second size. In this case, the gap 242*b* between top rail 120 of door frame 106 and the upper edge of electronic display 110 is smaller than that shown in FIG. 12A. Support plate 164*b* supports electronic display 110 closer to top rail 120 of door frame 106 than support plate 164*a*.

FIG. 12C depicts a support plate 164*c* that supports an electronic display 110 in door frame 106 of a third size. In this case, the gap 242*c* between top rail 120 of door frame 106 and the upper edge of electronic display 110 is approximately the same as gap 242*b* shown in FIG. 12B. Thus, support plate 164*c* supports electronic display 110 at about the same distance from top rail 120 of door frame 106 as support plate 164*b*. In the door of FIG. 12C, however, longer mounting blocks 108 are used on the sides of the electronic display to accommodate a narrower electronic display than that shown in FIG. 12B.

In one example, a system includes one 64 inch LCD screen that fits door widths that span 26⅜ inches to 30⅞ inches and heights from 69 1/16 inches to 71 1/16 inches. The hinges and brackets are common through the various door sizes. A common space profile can be extruded and cut to length to span the appropriate gap for each installation. In each installation, bezels mount to the door surface, overlap the gap, extend over the screen, and align to the screen's active area perimeter.

In certain implementations, the size of mounting blocks in door system can be selected to accommodate different sizes of an electronic display for a given size door frame. For example, for a given door frame size, opposing left and right pairs of mounting blocks 108*b* shown in FIG. 11B could accommodate a wider electronic display than opposing left and right pairs of mounting blocks 108*c* shown in FIG. 11C.

In some implementations, an electronic display assembly is initially supported on support elements using hangers on the electronic display assembly. While the electronic display assembly is supported on the hangers, the electronic display assembly is fastened to mounting blocks extending from the door frame. In some cases, the position of the electronic display assembly is adjusted while the electronic display assembly is hanging so that mounting features on the electronic display assembly align with corresponding mounting features on the mounting blocks and/or door frame.

Figure 13A:
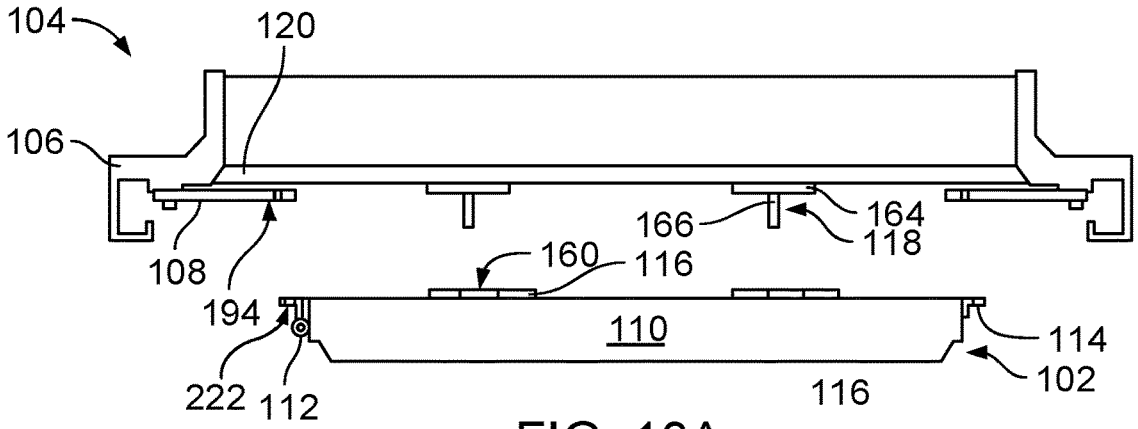
FIGS. 13A through 13D are schematic top views of a display door system illustrating installation of an electronic display in a door frame of a display case door.

FIGS. 13A through 13D are schematic top views of a display door system illustrating installation of an electronic display 110 in door frame 106 of display case door according to one implementation. Referring to FIG. 13A, electronic display assembly 102 can be positioned in front of insulated panel assembly 104. Door frame 106 includes a pair of display supports 118 spaced across insulated panel assembly 104 and attached to top rail 120. Each of display supports 118 includes support plate 164 and locating pin 166. In some examples, electronic display assembly 102 is lifted by one person or two persons into position such that slots 160 of hangers 116 are lined up with corresponding locating pins 166 on support brackets 164 attached to top rail 120 of door frame 106.

Figure 13B:
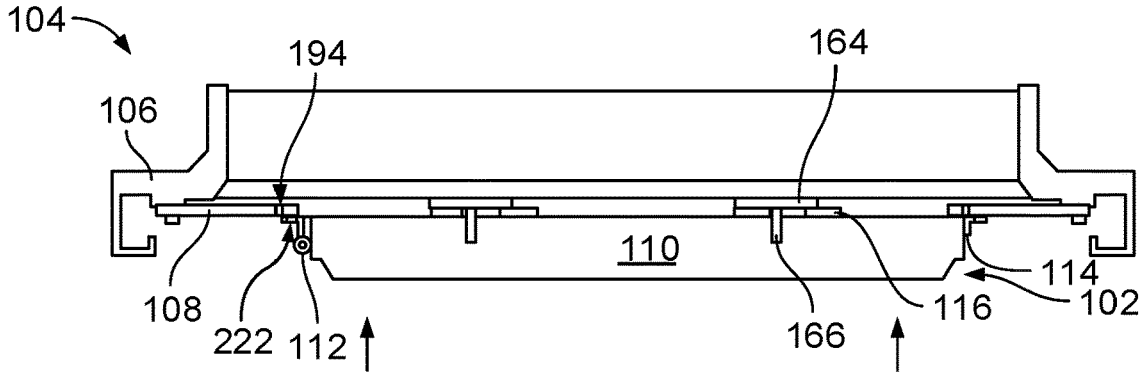

Referring to FIG. 13B, electronic display assembly 102 can be advanced rearwardly toward insulated panel assembly 104 (in the direction of the arrows) until locating pins 166 on support brackets 164 pass through slots 160 of hangers 116 on electronic display assembly 102. In this position, electronic display assembly 102 can be supported on locating pins 166. For illustrative purposes, in FIG. 13B, the mounting features of left side hinge bracket 112 are not aligned with the mounting features of the left mounting block 108.

Figure 13C:
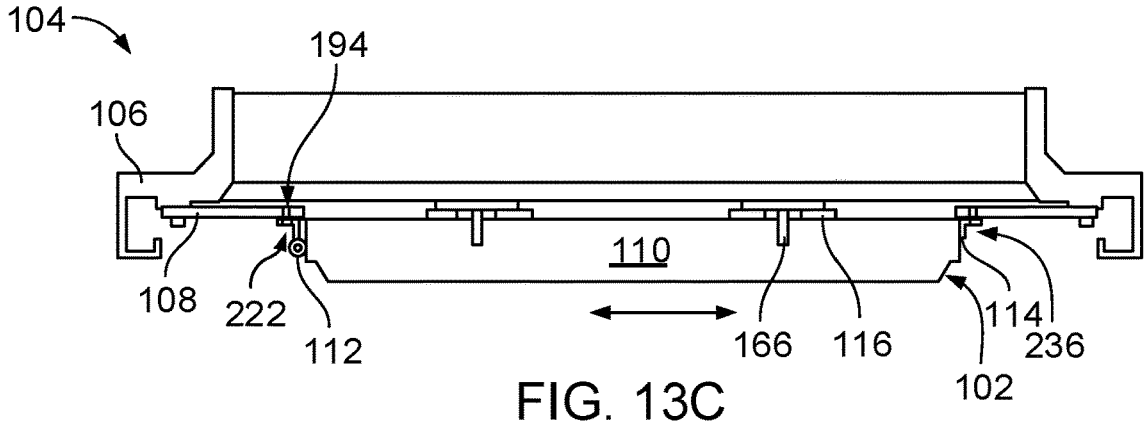

Referring to FIG. 13C, electronic display assembly 102 can be adjusted laterally in either direction (as indicated by the arrows), with slots 160 accommodating movement of locating pins 166 relative to electronic display assembly 102. The lateral position of electronic display assembly 102 can be adjusted until mounting holes 222 of left side hinge brackets 112 align with threaded mounting holes 194 of mounting blocks 108 on the left side of door frame 106. Slots 160 in hangers 116 allow for lateral adjustment of electronic display 110. As the lateral position of electronic display 110 on display supports 118 is adjusted, electronic display assembly 102 continues to be supported on locating pins 166 of display supports 118.

Figure 13D:
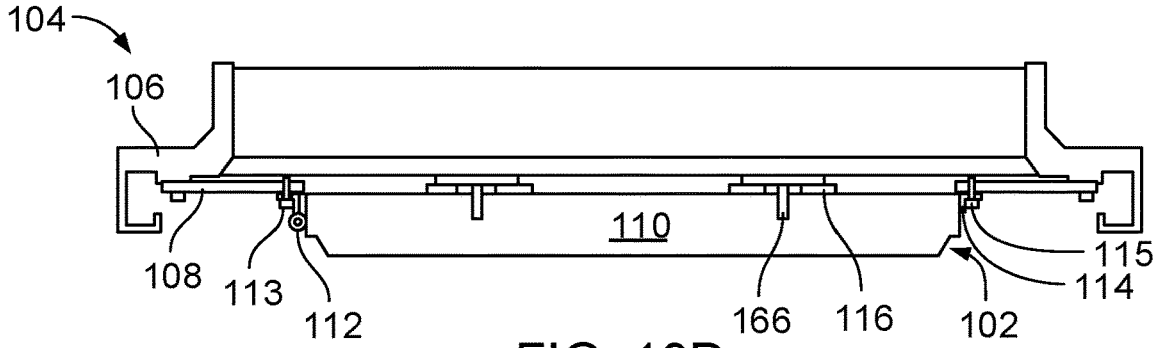

Referring to FIG. 13D, once the lateral position of electronic display assembly 102 has been adjusted to align the mounting features of left side hinge brackets 112 of electronic display assembly 102 and the corresponding mounting features of mounting blocks 108, screws 113 and screws 115 can be installed to secure electronic display assembly 102 to door frame 106. In one example, two screws 113 are installed to secure each of left side hinge brackets 112 on the left side of electronic display assembly 102, and two screws 115 are installed to secure each of right side brackets 114 on the right side of electronic display assembly 102.

Figure 14:
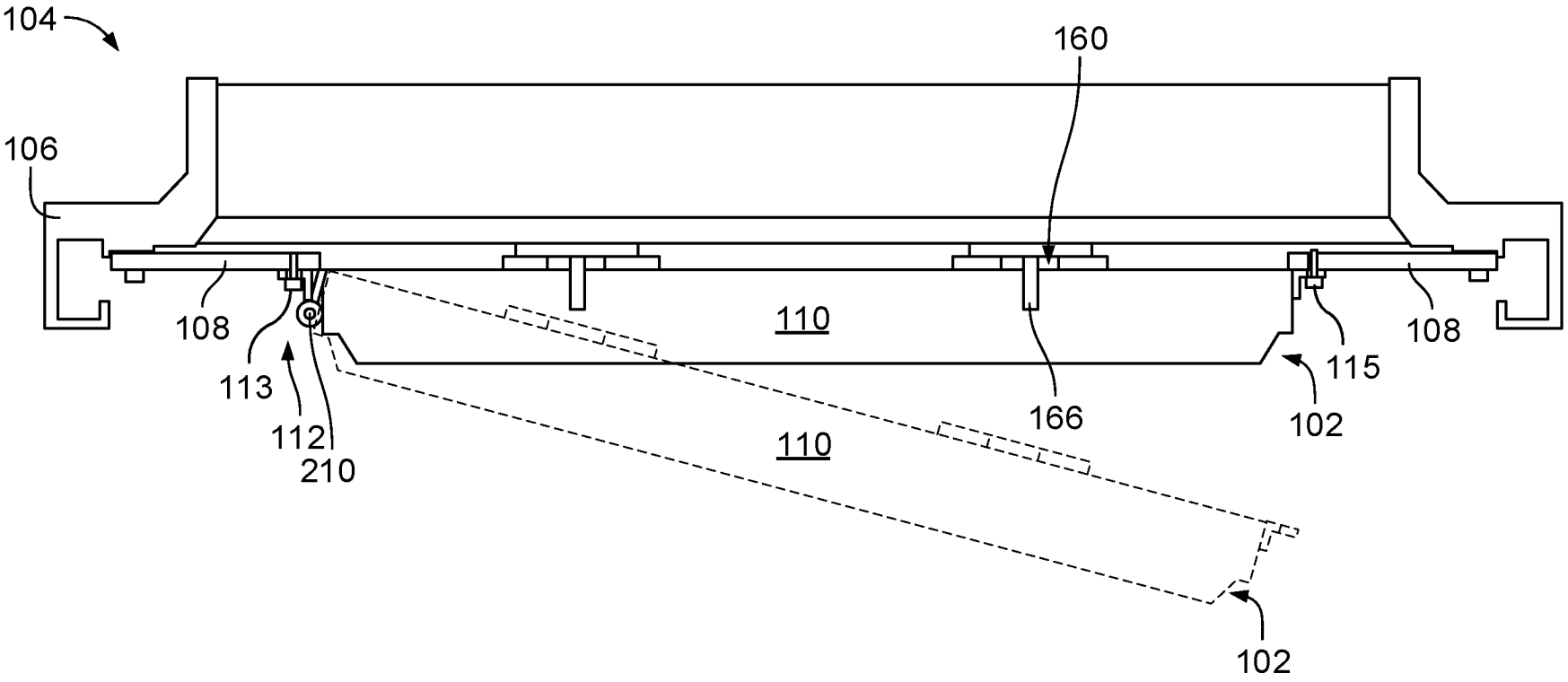
FIG. 14 illustrates swinging an electronic display away from an insulated panel assembly.

In some implementations, electronic display 110 can be swung on right left side brackets 112, away from glass panels 150 of insulated panel assembly 104 while display case door 100 is in service on a refrigeration system. FIG. 14 illustrates swinging electronic display 110 away from insulated panel assembly 104. Phantom lines show electronic display 110 in the swung-out position. In some implementations, screws 115 for right side bracket 114 are removed to allow the right side of electronic display 110 to be swung back. Screws 113 remain installed to support electronic display 110 on the hinged left side of door frame 106. Swinging electronic display 110 out can allow maintenance personnel to access components on the rear side of electronic display 110 and some components on the front side of insulated panel assembly 104.

In certain implementations, hangers 116 are used to support electronic display 110 during maintenance operations to remove, replace, or repair the electronic display. Screws 113 securing left side hinge brackets 112 and screws 115 securing right side brackets 114 can be partially or completely removed so that electronic display 110 can be separated from mounting blocks 108 and withdrawn from insulated panel assembly 104. Electronic display 110 can be supported on locating pins 166 of display supports 118 until maintenance personnel lift electronic display 110 away from insulated panel assembly 104.

With the electronic display 110 removed from the insulated panel assembly 104, service can be performed on the electronic display. Once service has been completed, the electronic display 110 can be repositioned in front of insulated panel assembly 104 and rehung on display supports 118. Screws 113 and screws 115 can be retightened or replaced to once again secure the electronic display assembly 102 in the door frame.

Referring back to FIG. 3, left bezel 124, top bezel 126, and right bezel 128 are coupled to a front surfaces of door frame 106 or to a front surface of electronic display 110 or both. Each of left bezel 124, top bezel 126, and right bezel 128 are sized to overlay at least a portion of each of a front surface of door frame 106, mounting blocks 108, left side hinge brackets 112, right side brackets 114, and/or support brackets 164. Any or all of left bezel 124, top bezel 126, and right bezel 128 can also overlay the front surface of a housing of electronic display 110. In some implementations, the front surface of electronic display 110 is flush with the front surface of door frame 106. In this case, left bezel 124, top bezel 126, and right bezel 128 can be flat.

In various implementations described above, an electronic display assembly 102 can be hung on display supports 118 and then the electronic display assembly 102 fastened to mounting blocks 108 that have been pre-installed on the sides (side rails 122) of a door frame 106 (such as shown in FIGS. 13A through 13D). In other implementations, the mounting blocks 108 can be pre-installed on electronic display assembly 102 before the electronic display assembly 102 is hung. Once the electronic display assembly 102 is hung in the door frame 106, the mounting blocks 108 on the electronic display assembly 102 can be fastened to the door frame 106 to secure the electronic display assembly 102.

In various implementations, door frame 106 has a width and thickness that allows display case door 100 to be installed and operated in an existing refrigerated display case without the need of retrofitting the display case. Display case door 100 can be operated with or without electronic display 110.

In certain implementations, electronic display 110 can be secured to door frame 106 by a latch assembly. For example, one or more of right side brackets 114 can include a latch member that couples with a complementary latch member on mounting block 108 that allows the right side of electronic display assembly 102 to be selectively latched and released from mounting blocks 108.

Figure 15B:
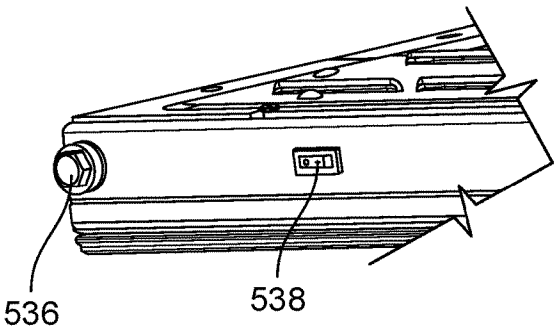
FIGS. 15A and 15B illustrate an exemplary display case door according to an implementation of the present disclosure.
Figure 15A:
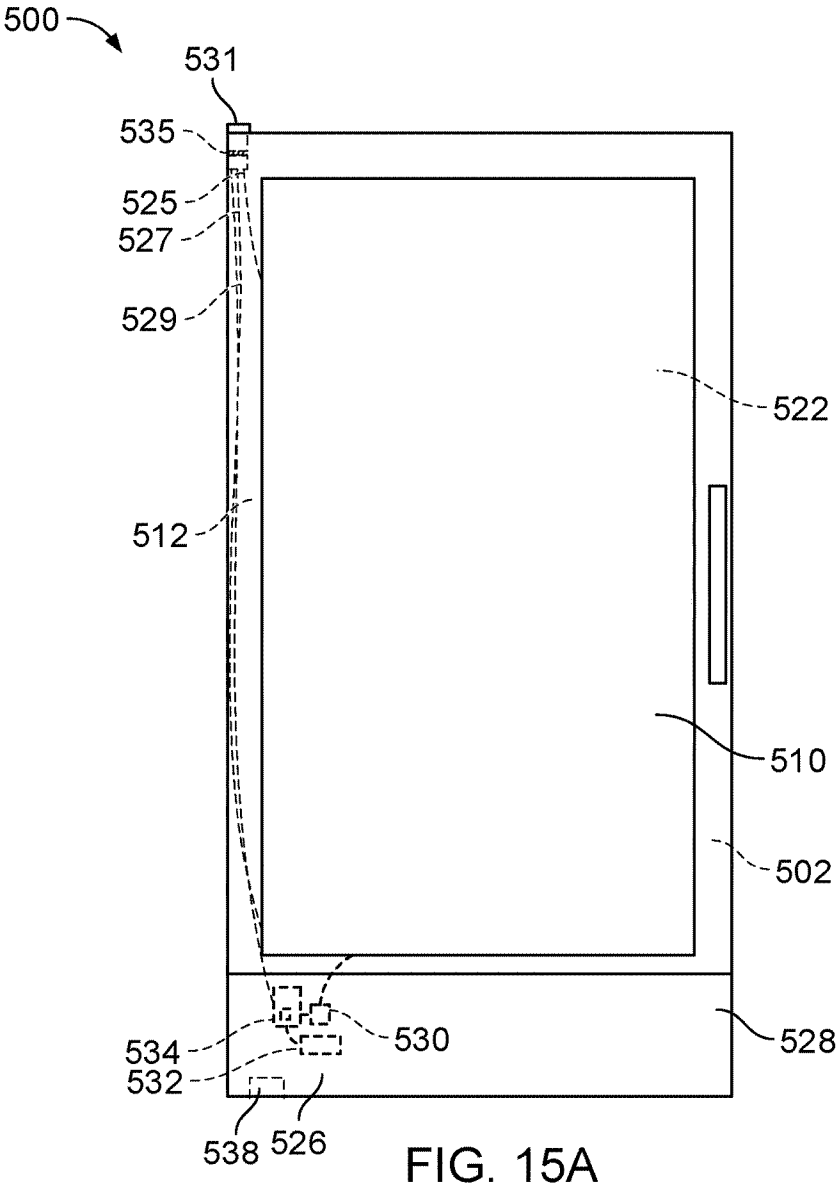

FIG. 15A illustrates an exemplary display case door 500 according to an implementation of the present disclosure. Display case door 500 includes hinge pin 531. In this example, display case door includes quick disconnect plug 535. Quick disconnect plug 535 is electrically coupled to a power cable 525, a ground wire 527, and one or more electrical wires 529 coupled to electronic display 510 or to circuitry module 526. In some implementations, power cable 525 includes at least a power supply cable, a ground cable, and a detachable ground lug in one wiring assembly with one plug on each end of the wiring assembly: For example, the electronic display 510) can have a male component while the door frame 502 can have the female component. The male component and the female component can be referred to as a pin and socket connection. The plug will have all the power, ground and neutral joined at the plug.

Similar to the display case door shown in FIGS. 1-14 above, display case door 500 includes a transparent panel assembly 522 and a door frame 502 that receives and secures an electronic display 510 to cover transparent panel assembly 522. Electronic display 510 can be attached to door frame 502 using mounting blocks 108, left side hinge brackets 112, and right side brackets 114 as described in FIGS. 1-14 above. Electronic display 510 has a height that is less than the interior height of frame 502, leaving a space 528 between the bottom of door 500 and the bottom edge of the electronic display 510 to place electrical components with door 500. For example, display case door 500 includes circuitry module 526 disposed under the electronic display 510. Circuitry module 526 includes at least a media player 530 in electronic communication with electronic display 510. Media player 530 controls media content presented on display 510. Circuitry module 526 can also include a power hub 532 and a power converter 534. Circuitry module 526 is releasably coupled to door frame 502.

In certain implementations, circuitry module 526 can include one or more quick disconnect plugs. A quick disconnect plug can be attached to the first end of a control cable. The quick disconnect plug can also be attached to power cable 529. The quick disconnect plug may include a power, audio, visual, or ground wire.

Referring also to FIG. 15B, display case door 500 includes a power switch 538 secured to door frame 512 near torque rod 536. Power switch 538 is electrically coupled to electronic display 510 to turn on and off the power to electronic display 510. Power switch 538 resides on bottom of door frame 512 and can be in line with power cable 525. Power switch 538 resides on door frame 512 to prevent customers or maintainers from inadvertently cycling power to display case door 500.

Figure 16A:
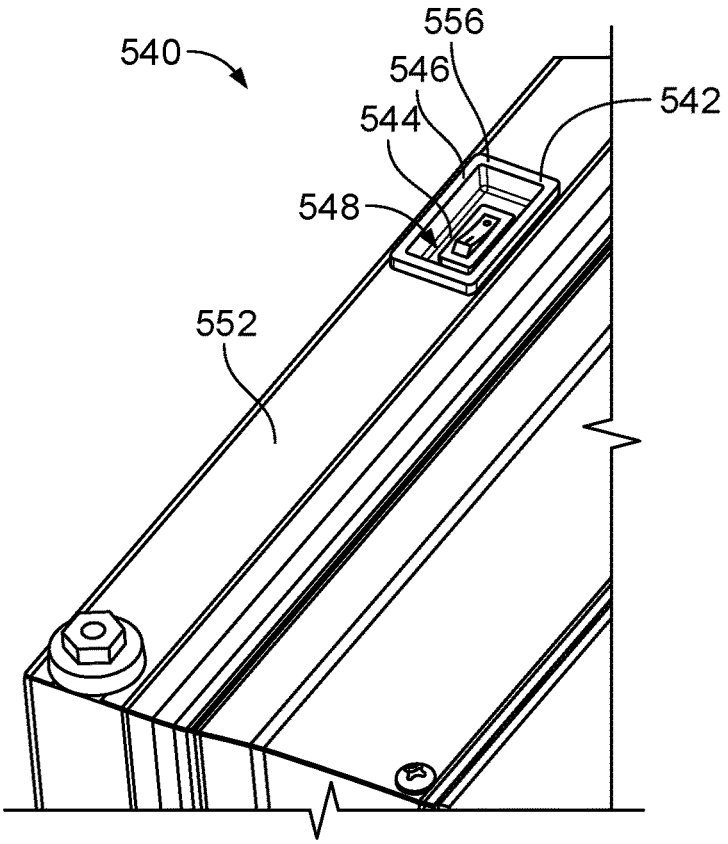
FIG. 16A illustrates an inset power switch on a bottom surface of a display case door.

In some implementations, a power switch for a display case door is inset into the door frame below a bottom surface of the frame. FIG. 16A is a perspective view of a power switch on a bottom surface of a door. The switch assembly 540 can include a molded bezel cover 542 with the power switch 544 inset into the door frame 512. The wires connected to the power switch 544 can be potted to water proof the switch. The molded bezel cover 542 on the power switch 544 may also protect the power switch 544 from damage when installed on the door.

Figure 16B:
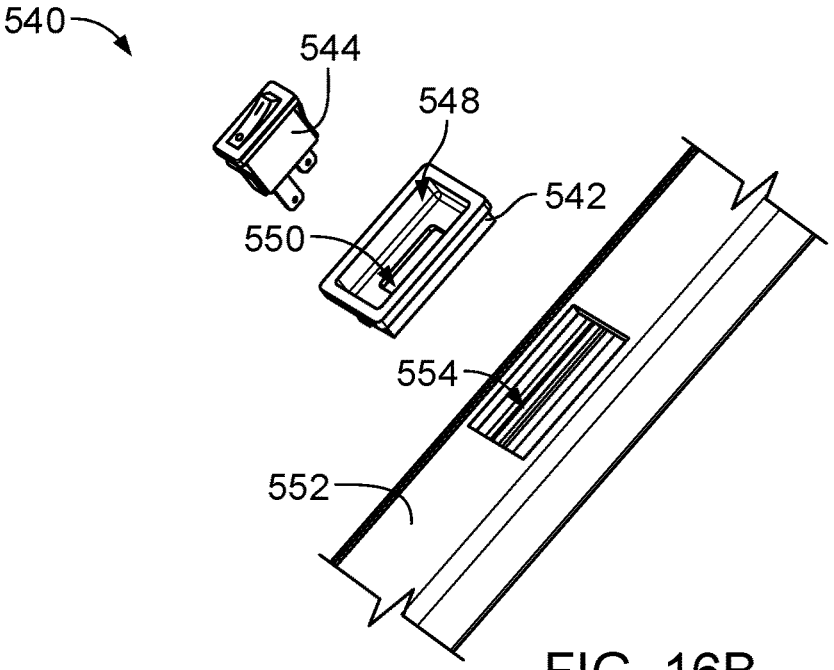
FIG. 16B is an exploded view of the switch assembly of FIG. 16A.

FIG. 16B is an exploded view of the 540 switch assembly of FIG. 16A. Molded bezel cover 542 includes rim 546, pocket 548, and aperture 550. Bottom rail 552 includes opening 554. Molded bezel cover 542 is installed in opening 554. Power switch 544 is installed in aperture 550 of molded bezel cover 542. Power switch 544 may reside in pocket 548. As shown in FIG. 16A, power switch 544 may be recessed relative to the exterior surface 556 of rim 546.

Referring again to FIG. 16A, power cables 525 can provide electrical power to electronic display 510 and power converter 534. Power converter 534 receives alternating current (AC) power from power cable 525 and converts the AC power to direct current (DC) power. For example, power converter 534 converts 110V AC power to 5V DC power. Power converter 534 is electrically connected to one or more media players 530. Power converter 534 is arranged inside display case door 500.

In various implementations described above, a system includes hinge brackets on a left side of an electronic display assembly and angle brackets on the right side of the electronic display assembly: In other implementations, the hinge bracket can be included on the right side of an electronic display. In still other implementations, a system can include only angle brackets (e.g., with both left and right sides having brackets similar to right side brackets 114), without any hinge brackets. In certain implementations, a system can include brackets on only one side, or include no brackets.

In various implementations described above, mounting blocks for an electronic display are in the form of a plate. Other forms of mounting blocks can be used, however. Other examples of mounting blocks include a bar, a rod, a tube, an angle, or channel.

In various implementations described above, an electronic display assembly includes hangers that be used to support an electronic display a door frame while the electronic display assembly is fastened to a door frame. In other implementations, an electronic display can be supported with other components. For example, a door frame can include a shelf on which an electronic display assembly can be rested while the electronic display assembly is fastened to the door frame (e.g., on a set of mounting blocks such as described above relative to FIGS. 1-14.)

While a number of examples have been described for illustration purposes, the foregoing description is not intended to limit the scope of the invention, which is defined by the scope of the appended claims. There are and will be other examples and modifications within the scope of the following claims. Furthermore, one of skill in the art would appreciate that features described in reference to a specific embodiment are not limited to that embodiment and can be interchanged with features of other embodiments.

What is claimed is:

1. A display case door comprising:

an insulated panel assembly, wherein the insulated panel assembly is transparent to visible light;

a door frame extending about and coupled to the insulated panel assembly, the door frame comprising:

a left side rail;

a right side rail; and two or more mounting blocks comprising:

one or more left side mounting blocks coupled to and extending inwardly from the left side rail; and one or more right side mounting blocks coupled to and extending inwardly from the right side rail; and an electronic display assembly comprising:

an electronic display; and one or more left side brackets coupled to the electronic display; and one or more right side brackets coupled to the electronic display;

wherein:

at least one of the left side brackets of the electronic display assembly is coupled to at least one of the one or more left side mounting blocks, at least one of the right side brackets of the electronic display assembly is coupled to at least one of the one or more right side mounting blocks, and the electronic display is at least partially supported in the door frame on at least one of one or more left side mounting blocks and at least one of the one or more right side mounting blocks.

2. The display case door of claim 1, wherein at least one of the two or more mounting blocks comprises a spacer plate configured to define a lateral spacing of the electronic display with respect to the door frame.

3. The display case door of claim 1, wherein at least one of the side rails comprises an inner rim, wherein at least one of the two or more mounting blocks spans a gap between the inner rim of the at least one side rail and a corresponding one of the side brackets of the electronic display assembly.

4. The display case door of claim 1, wherein at least one of the one or more left side brackets or at least one of the one or more right side brackets comprises a hinge.

5. The display case door of claim 1, wherein:

the door frame comprises one or more display supports, the electronic display assembly further comprises one or more hangers configured to couple with at least one of the display supports, and the hangers are configurable to support the electronic display in the door frame such that at least one of the side brackets is aligned with a corresponding one of the mounting blocks.

6. A display case door comprising:

an insulated panel assembly, wherein the insulated panel assembly is transparent to visible light;

a door frame extending about and coupled to the insulated panel assembly;

one or more mounting blocks coupled to and extending inwardly from the door frame; and an electronic display assembly comprising:

an electronic display; and one or more side brackets coupled to the electronic display, wherein:

at least one of the side brackets of the electronic display assembly is coupled to at least one of the one or more mounting blocks, and the electronic display is at least partially supported on at least one of the one or more mounting blocks.

7. The display case door of claim 6, wherein at least one of the mounting blocks comprises a spacer plate configured to define a lateral spacing of the electronic display with respect to the door frame.

8. The display case door of claim 6, wherein at least one of the one or more mounting blocks spans a gap between an inner rim of the door frame and a lateral edge of the electronic display assembly.

9. The display case door of claim 6, wherein:

the door frame comprises one or more display supports, the display supports are configurable to support the electronic display on the door frame such that at least one of the side brackets is aligned with a corresponding one of the mounting blocks.

10. The display case door of claim 6, further comprising a bezel configured to overlay at least a portion of at least one of the mounting blocks.

11. The display case door of claim 6, wherein at least one of the side brackets comprises a hinge, wherein the hinge is configured to allow the electronic display to swing out relative to the door frame.

12. The display case door of claim 6, wherein at least one of the side brackets comprises an angle bracket.

13. The display case door of claim 6, wherein:

the door frame comprises a side rail comprising an inner rim, and at least one of the mounting blocks is coupled to the inner rim.

14. The display case door of claim 6, wherein:

the door frame comprises one or more side rails each comprising an inner rim, and the one or more mounting blocks comprise an upper mounting block and a lower mounting block coupled to the inner rim of at least one of the one or more side rails.

15. The display case door of claim 6, wherein:

the door frame comprises a pair of opposing side rails each comprising an inner rim, and the one or more mounting blocks comprise:

one or more left mounting blocks coupled to a left inner rim, and one or more right mounting blocks coupled to a right inner rim.

16. The display case door of claim 6, wherein at least one of the one or more mounting blocks spans a gap between an inner rim of the door frame and a corresponding one of the side brackets of the electronic display assembly.

17. The display case door of claim 6, wherein:

the door frame comprises an inner rim, the display case door further comprises one or more fasteners configured to secure at least one of the one or more mounting blocks to the inner rim of the door frame.

18. The display case door of claim 6, wherein:

the door frame comprises an inner rim, the inner rim of the door frame comprises one or more mounting holes, wherein at least one of the mounting holes is aligned with a corresponding aperture in at least one of the mounting blocks, and the display case door further comprises one or more fasteners configured to secure the at least one mounting block to the inner rim of the door frame.

19. A method of supporting an electronic display in a display case door, comprising:

positioning an electronic display assembly in front of an insulated panel assembly of the display case door such that each of one or more side brackets of the electronic display assembly align with a corresponding spacer plate inwardly extending from a side rail of a door frame; and securing at least one of the one or more side brackets of the electronic display assembly to the corresponding spacer plate such that the electronic display is at least partially supported in the door frame.

20. The method of claim 19, further comprising, before positioning the electronic display assembly in front of the insulated panel assembly of the display case door:

selecting one or more spacer plates each having a width that at least partially spans a gap between the door frame and a lateral edge of the electronic display assembly, and coupling the selected one or more spacer plates with the door frame such that each of the one or more spacer plates extends inwardly from a side rail of the door frame.

* * * * *